US011493884B2

(12) United States Patent
Buehler et al.

(10) Patent No.: US 11,493,884 B2
(45) Date of Patent: Nov. 8, 2022

(54) TIMEPIECE RETROGRADE TOURBILLON OR KARUSSEL

(71) Applicant: Harry Winston SA, Plan-les-Ouates (CH)

(72) Inventors: Johnny Buehler, Gingins (CH); Emmanuel Bouchet, Saint Antoine (FR)

(73) Assignee: Harry Winston SA, Plan-les-Ouates (CH)

( * ) Notice: Subject to any disclaimer, the term of this patent is extended or adjusted under 35 U.S.C. 154(b) by 243 days.

(21) Appl. No.: 16/912,183

(22) Filed: Jun. 25, 2020

(65) Prior Publication Data

US 2021/0026304 A1 Jan. 28, 2021

(30) Foreign Application Priority Data

Jul. 22, 2019 (EP) ..... 19187588

(51) Int. Cl.
*G04B 17/28* (2006.01)
*G04B 1/00* (2006.01)
(Continued)

(52) U.S. Cl.
CPC ..... *G04B 17/285* (2013.01); *G04B 1/00* (2013.01); *G04B 13/02* (2013.01); *G04B 15/14* (2013.01); *G04B 17/06* (2013.01)

(58) Field of Classification Search
CPC ..... G04B 17/28; G04B 17/285; G04B 13/02; G04B 1/00; G04B 15/14; G04B 17/06
See application file for complete search history.

(56) References Cited

U.S. PATENT DOCUMENTS 7,527,423 B2 * 5/2009 Ruchonnet ..... G04B 17/285 368/127
10,481,557 B2 * 11/2019 Mutrux ..... G04B 17/285
(Continued)

FOREIGN PATENT DOCUMENTS

CH 705 938 A1 6/2013
CH 709 331 A2 9/2015
(Continued)

OTHER PUBLICATIONS

European Search Report dated Dec. 2, 2019 in European Application 19187588.9 filed Jul. 22, 2019 (with English Translation of Categories of Cited Documents), 5 pages.
(Continued)

*Primary Examiner* — Sean Kayes
(74) *Attorney, Agent, or Firm* — Oblon, McClelland, Maier & Neustadt, L.L.P.

(57) ABSTRACT

A horological movement including a tourbillon or karussel frame carried by an arm subjected to the torque of a first energy source, and a second energy source driving a frame pitch mobile driving the frame, and, for periodically controlling a retrograde movement of the arm, a release mobile connected to the second energy source and cooperating at a pallet-stone with an interrupted cam that a cam mobile kinematically connected to this arm includes, to allow advancing the arm in a direct direction as long as the pallet-stone is resting on the cam, and to control a rapid retrograde return of this arm during a drop of the pallet-stone between two of its successive support surfaces on the cam.

13 Claims, 17 Drawing Sheets

(51) Int. Cl.

| | |
|---|---|
| ***G04B 13/02*** | (2006.01) |
| ***G04B 15/14*** | (2006.01) |
| ***G04B 17/06*** | (2006.01) |

(56) References Cited

U.S. PATENT DOCUMENTS

| | | | | |
|---|---|---|---|---|
| 11,360,432 | B2 * | 6/2022 | Buehler | G04B 17/285 |
| 2014/0126338 | A1 * | 5/2014 | Forsey | G04B 17/285<br>368/127 |
| 2016/0231708 | A1 * | 8/2016 | Roth | G04B 13/008 |

FOREIGN PATENT DOCUMENTS

| | | | |
|---|---|---|---|
| CN | 1722026 | A | 1/2006 |
| CN | 103038711 | A | 4/2013 |
| CN | 103 439 872 | A | 12/2013 |
| CN | 103 439 872 | B | 12/2013 |
| CN | 103439872 | A | 12/2013 |
| CN | 104914707 | A | 9/2015 |
| CN | 104937501 | A | 9/2015 |
| EP | 1 465 024 | A1 | 10/2004 |
| EP | 1 465 024 | B1 | 10/2004 |
| WO | WO 03/048871 | A3 | 6/2003 |

OTHER PUBLICATIONS

Combined Chinese Office Action and Search Report dated Jun. 2, 2021 in Chinese Patent Application No. 202010710207.3, 6 pages.

* cited by examiner

TIMEPIECE RETROGRADE TOURBILLON OR KARUSSEL

CROSS-REFERENCE TO RELATED APPLICATION

This application claims priority to European Patent Application No. 19187588.9 filed on Jul. 22, 2019, the entire disclosure of which is hereby incorporated herein by reference.

FIELD OF THE INVENTION

The invention relates to a horological movement including at least one regulating organ which is a tourbillon or karussel including a frame, said movement including a drive mechanism including a fixed structure on which an arm carrying said frame is pivotally mounted about a main axis, said arm being subjected to the return torque of a first energy source, said drive mechanism further including at least one second energy source, arranged to permanently re-power said first energy source.

The invention also relates to a timepiece, in particular a watch, including such a movement.

The invention relates to the field of timepiece drive mechanisms, and to the field of timepiece display mechanisms.

BACKGROUND OF THE INVENTION

Fans of horological complications are sensitive to a certain animation of the displays of a timepiece, which can be achieved by retrograde display mechanisms, or else by tourbillon mechanisms or the like, which in addition guarantee better insensitivity to positions.

A bursting of the displays is also appreciated, and allows providing a new physiognomy of the dial or the mechanism.

Retrograde displays are generally limited to driving hands, or more rarely discs.

The retrograde drive of a tourbillon or karussel frame has never been possible, because a frame cannot turn back on its fixed wheel, and must always turn in the same direction. If a disconnecting system, by a cam or the like, is introduced, to move the frame back, the running stops during the retrograde movement, which is not admissible.

Document CH709331A2 in the name of SEIKO INSTR. describes a display mechanism which comprises a frame unit comprising an escapement and a regulator, and an operating unit configured to differentiate the speed of displacement of the frame unit with the passage of time and to displace the frame unit in the direction moving towards or away from a first axis which is the centre of a particular display area, wherein the operating unit displaces the frame unit so that the movement path, reproduced when the frame unit displaces in the direction moving towards the first axis which is the centre of the particular display area, is in continuity with the movement path reproduced when the frame unit displaces in the direction moving away from the first axis which is the centre of the particular display area.

SUMMARY OF THE INVENTION

The invention proposes to develop a retrograde drive mechanism which is capable of embedding inertia mobiles much larger than hands, in particular tourbillons or the like, and therefore to propose entirely new displays.

To this end, the invention relates to a horological movement according to claim 1.

The invention also relates to a timepiece, in particular a watch, including at least one such movement.

BRIEF DESCRIPTION OF THE DRAWINGS

Other features and advantages of the invention will appear upon reading the detailed description which follows, with reference to the appended drawings, where:

FIG. 15 shows, schematically, partially, and in perspective, a view from the side of the user, of a horological movement according to the invention: on the front and on the right, a block groups together, mounted coaxially, on the one hand an eight-shaped retrograde pivoting arm carrying a frame, and which carries a first end of a frame arm spring, constituting a first energy source, which is here fixed to the plate at its other end, and on the other hand a frame pitch mobile including a first wheel and a second wheel axially spaced apart and integral in rotation. The retrograde pivoting arm includes a toothed sector which indirectly meshes with a cam mobile, which carries a cam on a portion of its periphery; a release mobile includes a wheel belonging to a goingtrain powered by a second energy source which is here a main barrel, and includes a release finger, elastically linked to this wheel, and which includes a pallet-stone which follows the cam of the cam mobile. The wheel of the release mobile meshes with a setting-wheel which in turn meshes with a wheel of the frame arm block. The periodic drop of the pallet-stone relative to the cam track controls a rapid retrograde movement, and, to avoid runaway, a wheel of the goingtrain cooperates with a speed-regulating mobile, in turn cooperating with a pallet, visible in the left portion of the figure;

FIG. 16 is a top view of the mechanism of FIG. 15, in a starting position of the frame arm in its travel, which takes place in a clockwise direction, about the axis of the frame arm block, and at a ten o'clock angular position relative to this axis;

FIG. 17 is similar to FIG. 16, and shows the position of FIG. 15 where the frame is in the eleven o'clock position;

FIG. 18 is similar to FIG. 16, and shows the position of the frame at twelve o'clock; this figure clearly shows the cooperation of the pallet-stone of the release mobile with the cam of the cam mobile;

FIG. 19 is similar to FIG. 16, and shows the position of the frame at two o'clock, in a position immediately preceding the drop of the pallet-stone, which is here edge to edge with a point of the cam;

FIG. 20 is similar to FIG. 16, and is located just after the drop of the pallet-stone, which escapes from the cam wheel at a clearance of the latter, while the retrograde pivoting arm performs a return to the left of the figure, the frame, in turn, turning in the same direction;

FIG. 21 is similar to FIG. 16, and is located at the end of the drop of the pallet-stone, the release mobile has almost performed a full turn, and the pallet-stone will soon again come alongside the cam, while the retrograde pivoting arm moves towards its starting position of FIG. 16;

FIGS. 22 to 27 illustrate, in perspective, the cooperation of the various components together, FIGS. 22 to 25 and 27 being seen from the side opposite the user, and FIG. 26 from the side of the user;

FIGS. 28 to 30 illustrate, in top, bottom, and side views, a movement including such a mechanism;

FIG. 31 is a detail, in a plan view, of the release mobile;

DETAILED DESCRIPTION OF PREFERRED EMBODIMENTS

Figure 1:
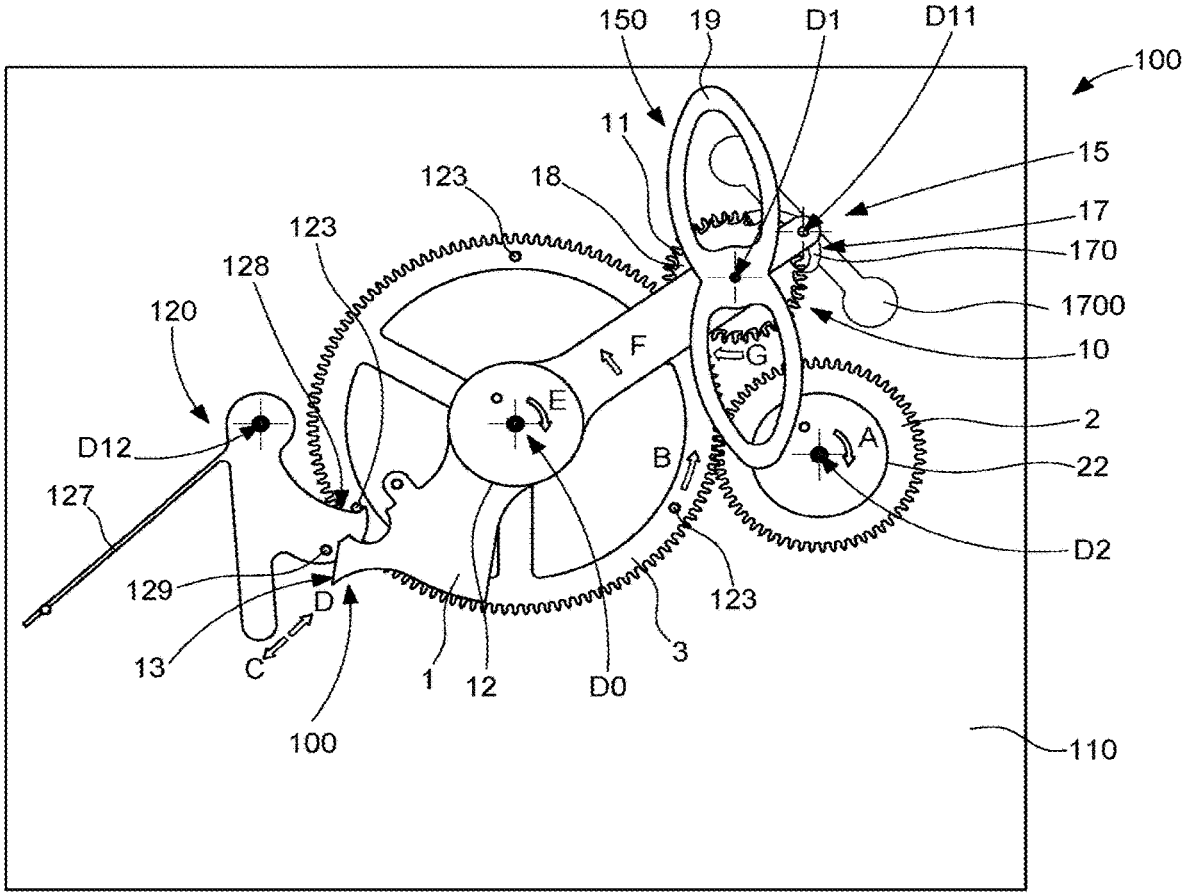
FIG. 1 shows, schematically, partially, and in a plan view, a horological movement according to the invention.

The invention relates to a horological movement 500 including at least one regulating organ 15 which is a tourbillon or a karussel including a frame 150, and including a timepiece drive mechanism 100, which has the advantage of being able to be used in a watch, or else in a static timepiece, with new features.

This drive mechanism 100 includes a structure 110, such as a plate, bridge or the like, on which an arm 1 pivoting about a main axis D0 is mounted. This arm 1 is carrying a first mechanism, which constitutes a satellite 10, which is pivotally mounted on the arm 1 around a first pivot axis D1, which is distant from the main axis D0. This satellite 10 includes a first wheel 11, which is pivotally mounted about the first pivot axis D1 or a secondary pivot axis D11 which is parallel thereto.

The arm 1 is subjected to the return torque with a first energy source 12, such as a barrel, a weight system, or the like.

Figure 2:
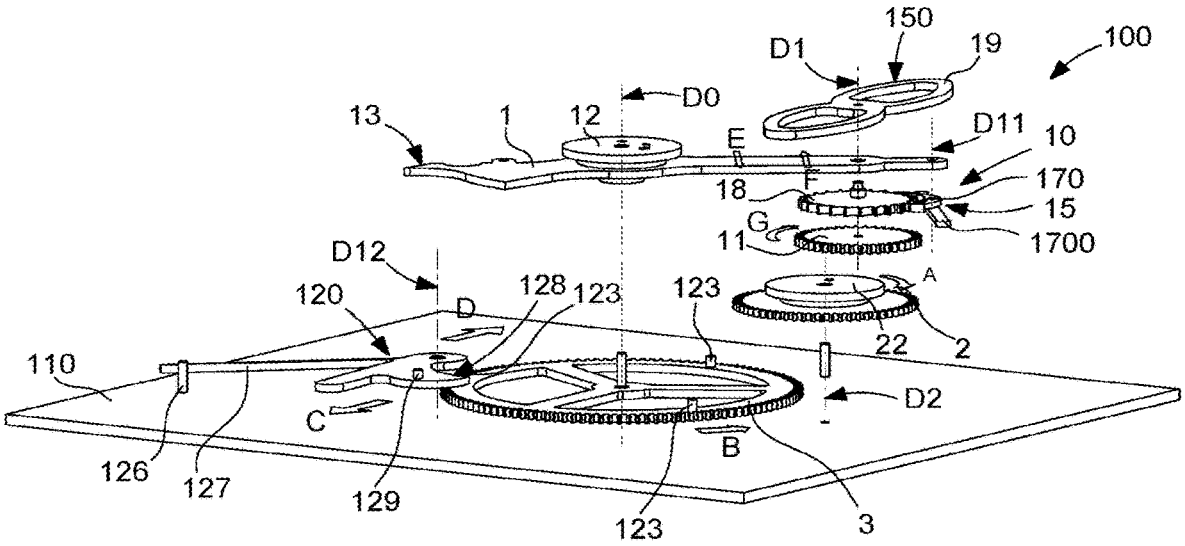
FIG. 2 shows, schematically, and in exploded perspective, the movement of FIG. 1.
Figure 3:
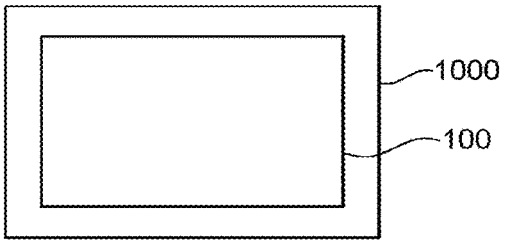
FIG. 3 is a block diagram showing a timepiece including such a movement.
Figure 4:
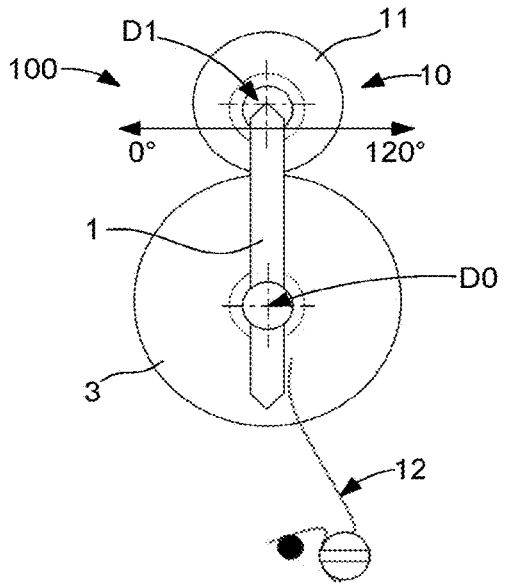
FIGS. 4 to 9 partially illustrate another variant, operating on an angular travel of 120° of the arm, as visible in FIG. 4 in a plan view, like FIGS. 5 to 8 which illustrate the positions of the mobiles at different instants, FIG. 9 being a side view of this mechanism.

The drive mechanism 100 also includes at least one second energy source 22, which is arranged to directly or indirectly subject a third mobile 3 that the drive mechanism 100 includes to a return torque 3, through a second mobile 2 pivotally mounted about a second pivot axis D2, as in the particular and non-limiting variant illustrated in FIGS. 1 and 2.

This second energy source 22 is the main energy source, and it is arranged to store more energy than the first energy source 12.

The first wheel 11 is arranged to roll on the third mobile 3 in a steady forward rolling movement, under the action of the return torque of the first energy source 12.

The satellite 10 thus constitutes a planetary mobile, which displaces in rotation about the third mobile 3, about the main axis D0, always in the same direction, according to the arrow G (clockwise direction in FIG. 1), and at constant speed.

Specifically to the invention, the third mobile 3 is arranged to remain in a fixed position during a first elementary travel of the satellite 10, and to perform a rotation, and in particular a rapid rotation, always in one direction, that of the anti-clockwise arrow B in FIGS. 1 and 2, during a second elementary travel of the travel of the satellite 10, under the action of the second energy source 22.

And the first wheel 11 drives the frame 150 of the tourbillon or karussel, or constitutes the frame 150 of the tourbillon or karussel.

Thus, relative to the fixed structure 110, the arm 1 displaces in the direction of the arrow E under the action of the first energy source 12 relative to the third mobile 3 when the latter is stopped, while, when the third mobile 3 is returned under the action of the second energy source 22, the arm 1, which is carried by the third mobile 3, displaces in a retrograde fashion in the direction of the arrow F, relative to the fixed structure 110, during the second elementary travel of the satellite 10.

It is understood that the satellite 10 continuously rolls around the third mobile 3, and that it continues to turn relative to the third mobile 3 during the rotation of the latter. There is therefore an alternation of first elementary travels and second elementary travels.

Due to the successive rotations of the arm in the first forward direction according to the arrow E, and in the second reverse direction according to arrow F, axis D1 performs a limited angular travel around the main axis D0.

In a particular and non-limiting manner, the first elementary travel of the satellite 10 is much greater than the second elementary travel of the travel, in particular more than twenty times greater than the latter.

In the advantageous example illustrated by FIGS. 1 and 2, the complete cycle lasts one minute, with fifty-eight seconds of slow speed travel of the arm 1 in the first elementary travel, and two seconds of rapid return of the arm 1 in the second elementary travel.

The invention however allows otherwise modulating the ratio between the first travel portion and the second elementary travel of the travel, it is for example imaginable to obtain first elementary travel and second elementary travel which are equal.

In the variant illustrated in FIGS. 1 and 2, to manage the rotational movement of the third mobile 3, the drive mechanism 100 includes stop means 120, which are fixed to the structure 110, and which are more particularly arranged to cooperate with complementary stop means 123 that the third mobile 3 includes for holding it in position, or that another external mobile directly or indirectly meshing with the third mobile 3 includes. The stop means 120 more particularly include a release lever, which is arranged to cooperate successively with pins distributed over the third mobile 3, and which constitute these complementary stop means 123 in the non-limiting example illustrated by FIGS. 1 and 2. In the illustrated example these pins are angularly disposed in a regular manner. However, it is possible to design other angular spacings, to make particular displays.

These stop means 120 can be disconnected, under the action of disconnecting control means 13 that the arm 1 includes, when the first wheel 11 ends its first elementary travel, to allow the pivoting of the third mobile 3 in a single direction (anti-clockwise arrow B) under the action of the second energy source 22 by causing a retrograde rotation of the arm 1 until its angular travel starts.

When the third mobile 3 is stopped in an angular stop position, the first wheel 11 performs a first elementary travel, and the arm 1 displaces in forward angular travel at a slow speed which is its display speed. At the end of this first elementary travel of the first wheel 11, the disconnecting control means 13 disconnect the stop means 120, and the third mobile 3 is then free and subjected to the torque of the second energy source 22, directly or through the second mobile 2 according to the selected construction variant. The third mobile 3 then performs a rotation, and more particularly a sudden and almost instantaneous rotation, before returning to another angular abutment position between another pin 123 and the release lever 120. And this rotation of the third mobile 3 causes the retrograde return of the arm 1 to its angular travel start position, and in particular in the illustrated case at an accelerated speed which is much higher than its slow display speed.

In another variant, the first wheel 11 is arranged to roll inside the third mobile 3. Many other configurations are possible, in particular concerning the relative positions of the different pivot axes, with adapted setting-wheel cascades.

Naturally, it is still possible to subject the third mobile 3 to the torque of at least one third energy source, for example in direct meshing.

The operation of the drive mechanism 100 is dependent on the level of energy available at the second energy source 22. In the case where the drive mechanism 100 is integrated into a watch, the second energy source 22 is advantageously recharged by an automatic winding mechanism, which is not detailed here because it is well known to the person skilled in the art: the first energy source 11 is permanently re-coiled by the second energy source as long as the latter has enough energy, this first energy source 11 thus constitutes a buffer, and the driving of the satellite 10 by this first energy source 11 is thus a mechanism called constant force mechanism, or more specifically constant torque mechanism, until the end of the main barrel power reserve In the very compact variant illustrated by FIGS. 1 and 2, the stop means 120 include a lever, which forms a release lever, and which is pivotally mounted on a lever axis D12, and which is returned in the direction of the arrow D by elastic return means 127, such as a spring or the like. This lever carries a lever pin 129.

The arm 1 includes a ramp 13, which is arranged to cooperate with the lever pin 129, at the end of the forward angular travel of the arm 1, and to push the lever in the direction of the arrow C, which allows eclipsing a beak of the lever including a support surface 128, which until then maintained in position an abutment pin 123, that the third mobile 3 includes (which includes three at 120° in this case). The third mobile 3 is then freed, and can turn, its pin 123 previously immobilised being able to go under the arm 1. The position of the pins 123 directs the release, they guarantee the precision of the duration of a total travel period.

Advantageously, the arm 1 includes limiting means 20, which tend to oppose the motor torque of the first energy source 12, and which are arranged to limit the rolling speed of the first wheel 11. Indeed, anything that can slow down the system is advantageous for a regular operation of the constant force mechanism that the invention constitutes.

More particularly, these limiting means 20 are braking and/or friction and/or regulation means. They may in particular include aerodynamic braking means, by Eddy currents, or the like. For example, the first wheel 11 can carry a seconds-hand.

Still more particularly, as in the non-limiting case illustrated by FIGS. 1 and 2, the limiting means 20 are means for regulating the rolling speed of the first wheel 11 around the third mobile 3. The regulating mechanism is preferably at the satellite 10 which constitutes a planetary mobile.

As visible in a non-limiting variant illustrated by FIGS. 1 and 2, the means for regulating the rolling speed of the first wheel 11 around the third mobile 3 include a stopper 17, such as a pallet or the like, and which is arranged to discontinuously cooperate with the first wheel 11, or with a synchronous mobile of the first wheel 11, or with a fourth mobile directly or indirectly meshing with the first wheel 11.

Particularly and as shown in FIGS. 1 and 2, the second pivot axis D2 is parallel to the main axis D0 and distinct therefrom.

Particularly and as shown in FIGS. 1 and 2, the third mobile 3 is arranged to pivot about the main axis D0.

In particular, the satellite 10 constitutes all or part of the limiting means 20, and is a regulating organ 15.

More particularly, the regulating organ 15 includes at least one inertial mass 1700 subjected to an alternating pivoting movement by a pallet 170, that the stopper 17 includes, and which is arranged to cooperate with a ratchet 18 directly or indirectly driven by the first wheel 11. This pallet 170 allows limiting the speed to avoid runaway, in particular during the rapid return in 2 seconds.

More particularly, the ratchet 18 is coaxial with the first wheel 11.

More particularly, this ratchet 18 is an escapement wheel.

When the regulating organ 15 is a tourbillon, the first wheel 11 drives the tourbillon frame 150, or else constitutes the frame 150 of the tourbillon. In this case, the axis of the resonator mechanism, typically a balance-spring, that the regulating organ 15 includes, is coincident with the first pivot axis D1.

When the regulating organ 15 is a karussel, the first wheel 11 drives the karussel frame or constitutes the karussel frame. In this case, the axis of the resonator mechanism, typically a balance-spring, that the regulating organ 15 includes, is a secondary pivot axis, parallel to the first pivot axis D1, for example located at the distal end of a regulator 19 as illustrated in FIGS. 1 and 2.

More particularly, the regulating organ 15 includes a regulator 19, which is driven directly or indirectly by the first wheel 1.

More particularly, this regulator 19 is synchronous with the first wheel 11, and is capable of constituting a first display of a first time quantity.

Still more particularly, the regulator 19 is a tourbillon or karussel frame.

Each mobile of the movement drive mechanism according to the invention can be used for a particular display. Thus, more particularly, the arm 1 constitutes or drives a display of a second time quantity. This arm can carry eccentric displays, for example on stars pivotally mounted on the arm 1.

Similarly, more particularly, the third mobile 3 constitutes or drives a display of a third time quantity, for example a display of the minutes advancing by jumps.

More particularly, the second mobile 2 constitutes or drives a power reserve display.

It is understood that this drive mechanism specific to the invention allows very lively displaying the passage of time, by the very visible rolling of the first wheel 11 on the third mobile 3, and by the periodic retrograde return of the arm 1. Each mobile can be used to carry a decentred display.

The invention also relates to a timepiece 1000 including at least one such horological movement 500, and which in a first variant is a watch. Its first energy source 12 and/or its second energy source 22 can conventionally include at least one barrel, and/or one electromechanical energy source, or the like. Advantageously, the second energy source 22 is recharged by an automatic winding mechanism.

In another variant, the timepiece 1000 is static, and may in particular be a clock. Its first energy source 12 and/or its second energy source 22 can conventionally include at least one barrel, and/or one electromechanical energy source, or the like. Or else its first energy source 12 and/or its second energy source 22 includes at least one weight, and this timepiece 1000 then includes means for winding each weight. However, preferably, the first energy source 12 is a buffer barrel, which allows only the second energy source 22 which powers the first energy source 12 to be wound.

Figure 5:
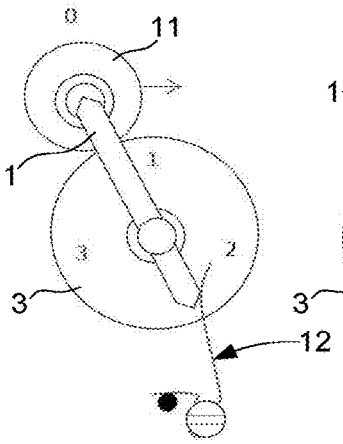
Figure 6:
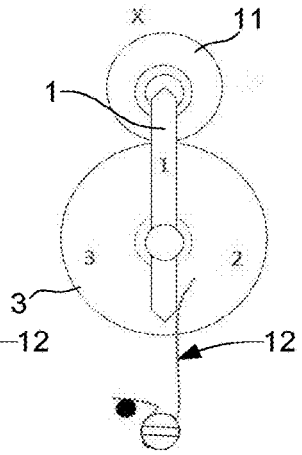
Figure 7:
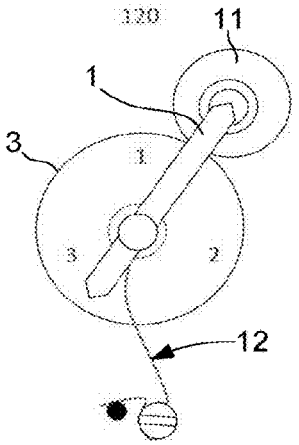
Figure 8:
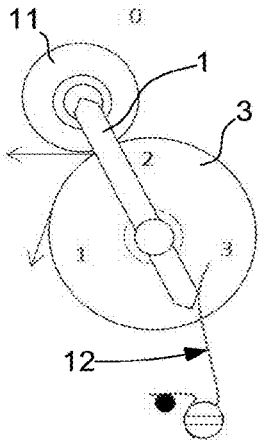
Figure 9:
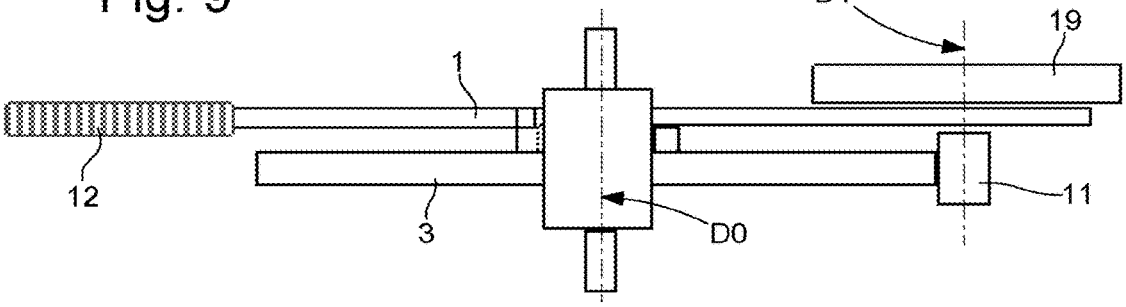

The principle of the invention is applicable to many other variants, and to many particular applications. This principle is illustrated, in a simplified manner compared to FIGS. 1 and 2, by FIGS. 4 to 9, which include only the first energy source 12, illustrated in the shape of a simple flat spring, the arm 1 carrying the first wheel 11, and the third mobile 3 on which this first wheel 11 turns. In this example, a tourbillon frame, carried by the first wheel 11, makes one turn per minute, the first wheel 11 displaces on the third mobile 3 for about 18 seconds when the third mobile 3 is still in the fixed position, and continues to roll on this third mobile for the two seconds that the retrograde return of 120° of the third mobile 3 in the counterclockwise direction in these figures, lasts. FIG. 5 shows the assembly in position just after such a retrograde return; FIG. 6 shows an intermediate position X; FIG. 7 shows the extreme angular position of the arm 1 in time travel, and FIG. 8 illustrates the retrograde return in an anti-clockwise direction of the third mobile (visible by the change of position of the guide-marks 1, 2, 3) and of the arm 1 that it carries.

Figure 10:
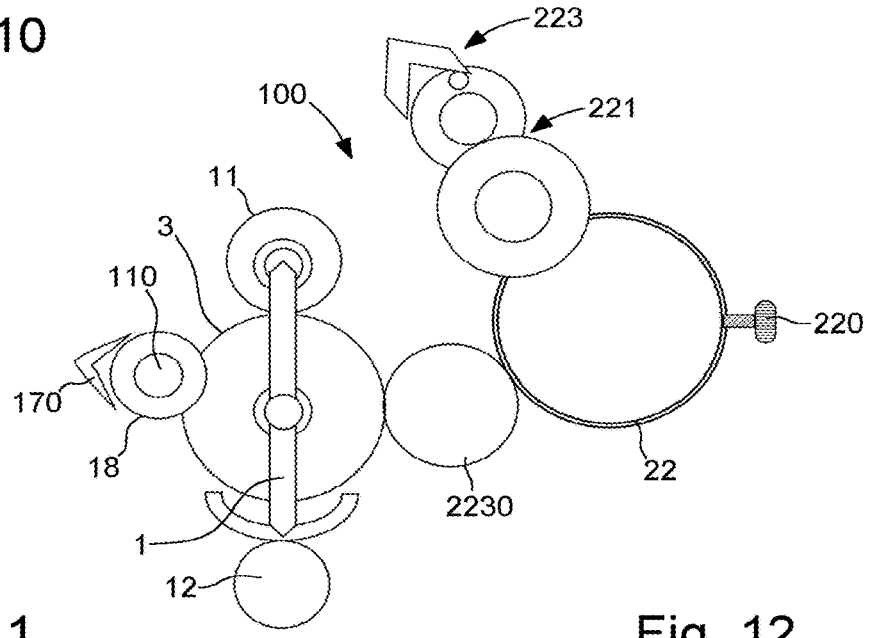
FIG. 10 shows, schematically, and in a plan view, yet another variant of the mechanism according to the invention.

FIG. 10 illustrates yet another variant, with an arm 1 forming a winding rack on a winding barrel of the frame arm, constituting the first energy source 12, which drives the arm 1 of the frame; under the effect of its torque, the tourbillon frame is driven and performs its rotation around the circumference of the third mobile 3, the arm 1 displaces depending on the frequency and the gear ratio. The arm 1 driving the frame displaces from its first position of 0° and arrives at its maximum position 120°. At this moment, there is an unlocking of the second energy source 22, here constituted by the barrel of the basic movement of a watch. This barrel is in chain with a reduction mobile 2230, and the latter in connection with the third mobile 3. The force of the movement barrel 22 will drive the reduction mobile 2230 and in fact will drive the third mobile 3 in 120° counterclockwise rotation. The displacement in degrees of the third mobile 3 is managed via a geartrain 221 and positioned by a stop pin at a position bolt 223, this geartrain 221 can be linked either to the reduction mobile 2230, or with the movement barrel 22. To manage the return over a duration of about 2 seconds, a regulator with inverter, including in particular a pinion, a ratchet 18, a pallet 170, is in series with the third mobile 3, and allows adjusting the duration of the retrograde return, in particular comprised between 1 and 10 seconds. During the 120° displacement of the third mobile 3, the first energy source 12, here the spring of the frame arm, is re-coiled, the frame continues to operate by displacing over the circumference of the third mobile 3. This variant of the FIG. 10 allows managing the angular travel other than by the pins 123 of the variant of FIGS. 1 and 2, which are here replaced by the position geartrain 221 it is here possible to manage other angular values, for example 360° to display a date passage, or the like.

It is noted that the basic movement barrel spring no longer intercedes with the goingtrain as in a conventional movement. Now it has the unique function of giving the necessary impulse to the positioning of the third mobile 3.

The first energy source 12, here the spring of the frame arm, has a pre-winding providing the torque necessary for the operation of the tourbillon, this force will remain constant. The angular travel of 120° in counterclockwise rotation of the third mobile 3 regularly coils the frame arm spring.

Figure 11:
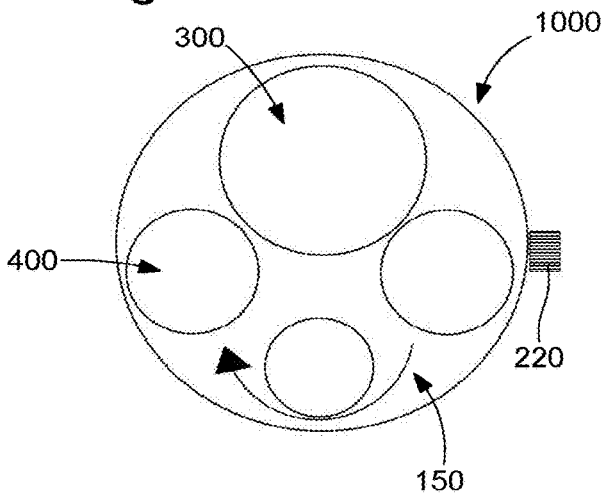
FIGS. 11 to 14 illustrate, in a plan view, different locations on a watch of a mechanism according to the invention.
Figure 12:
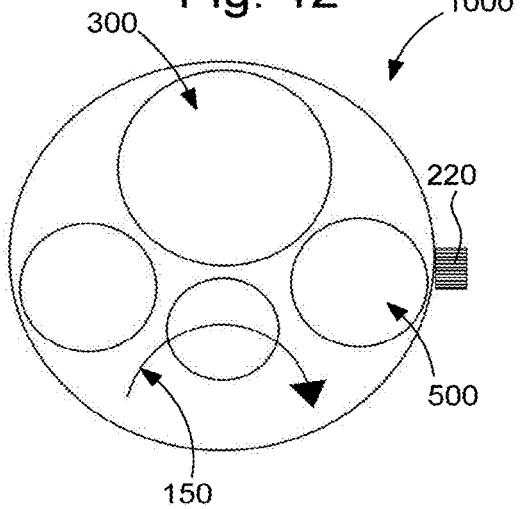
Figure 13:
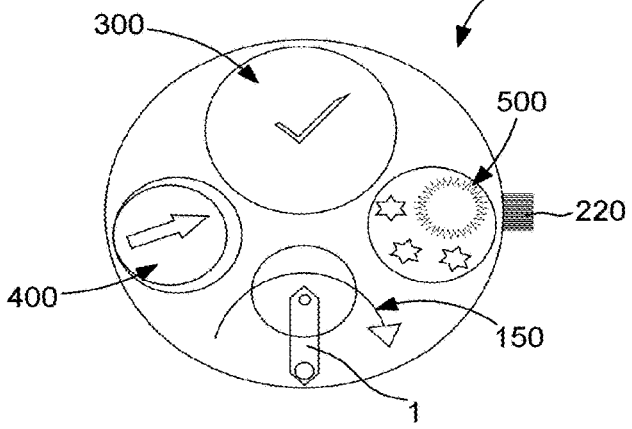
Figure 14:
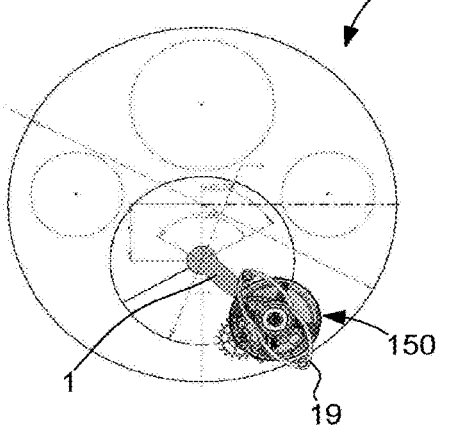
Figure 15:
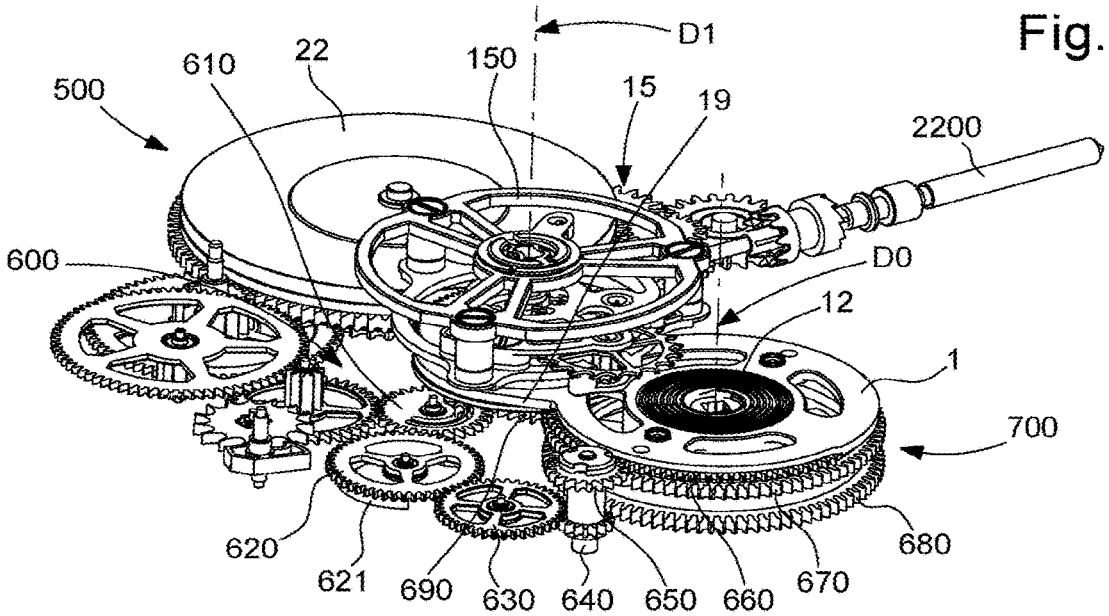
FIGS. 15 to 31 illustrate, on the basic principle of FIG. 10, a particular embodiment of the invention.
Figure 16:
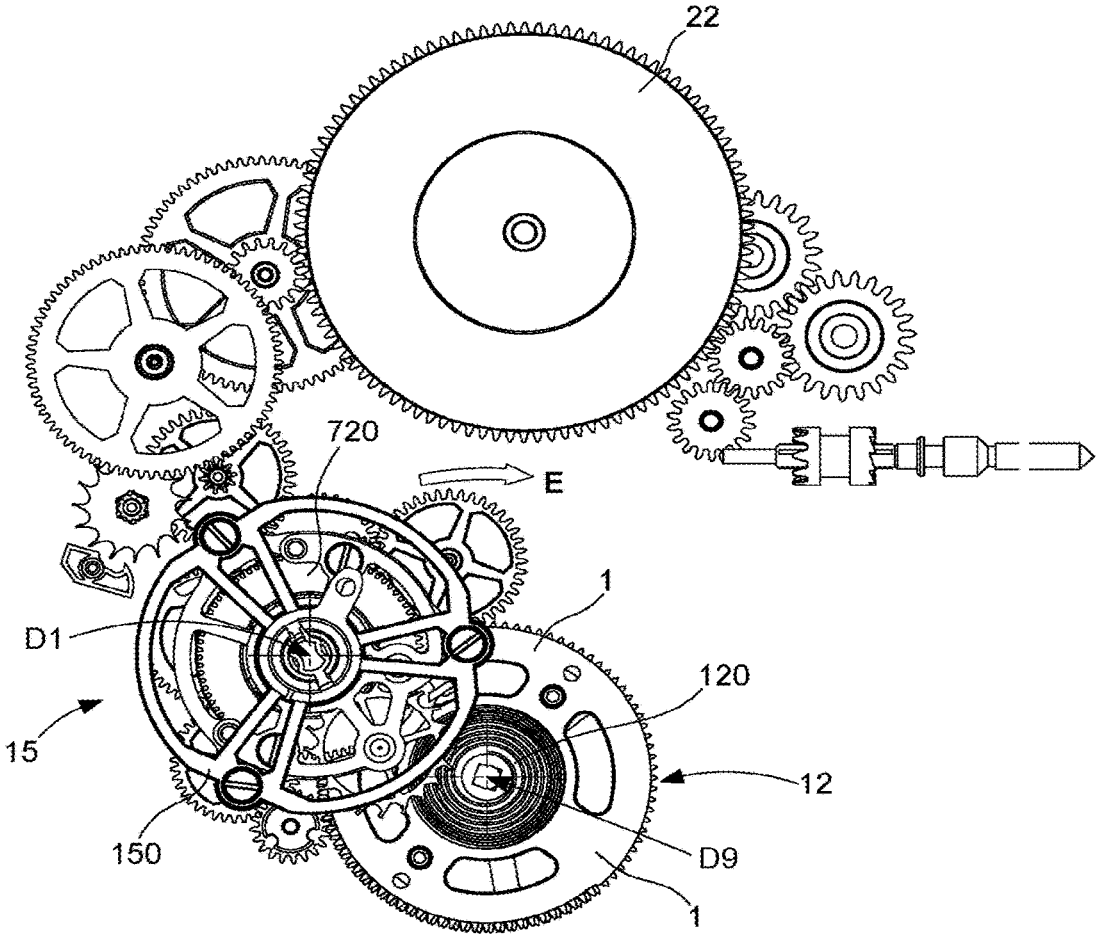
Figure 17:
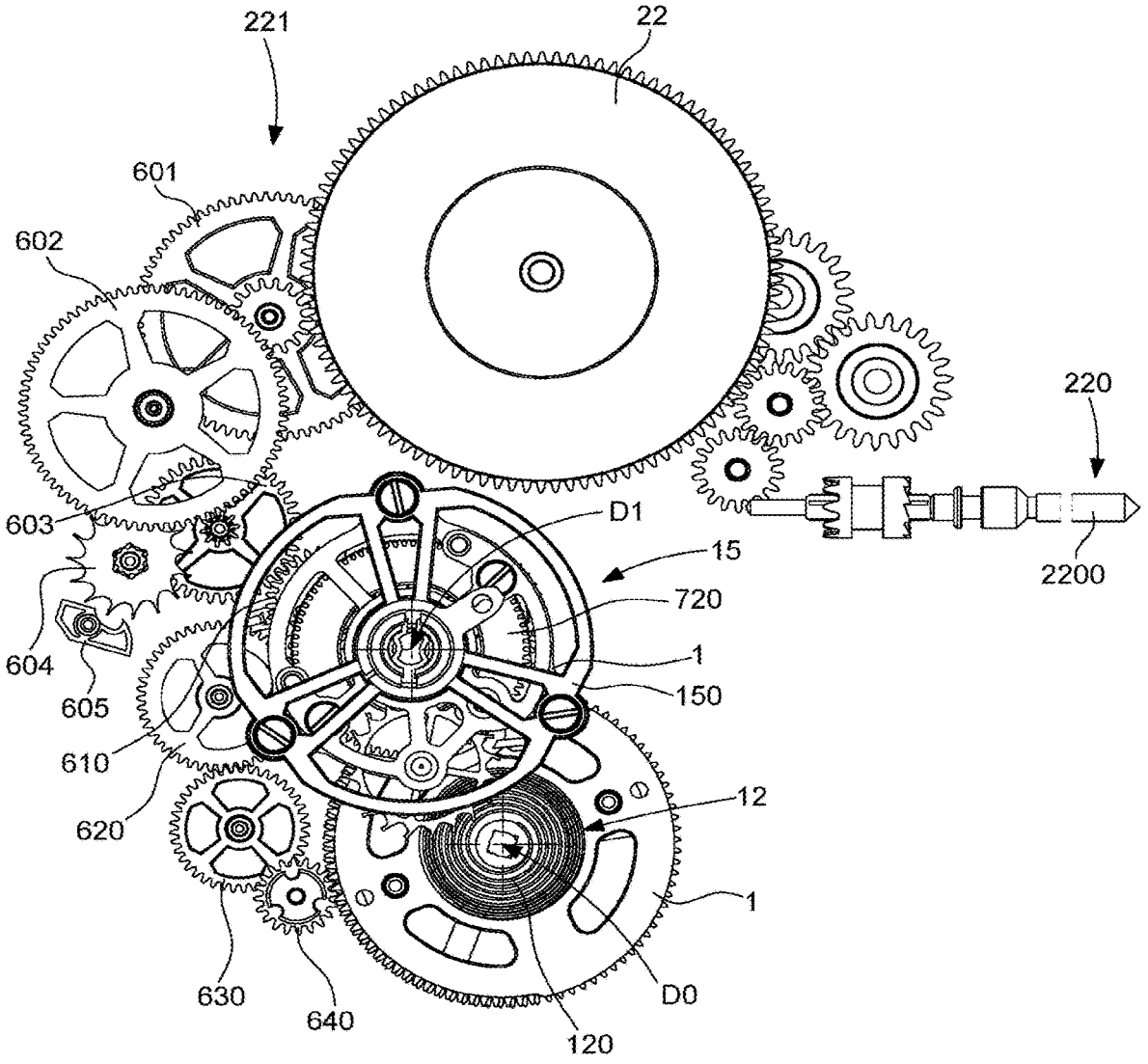
Figure 18:
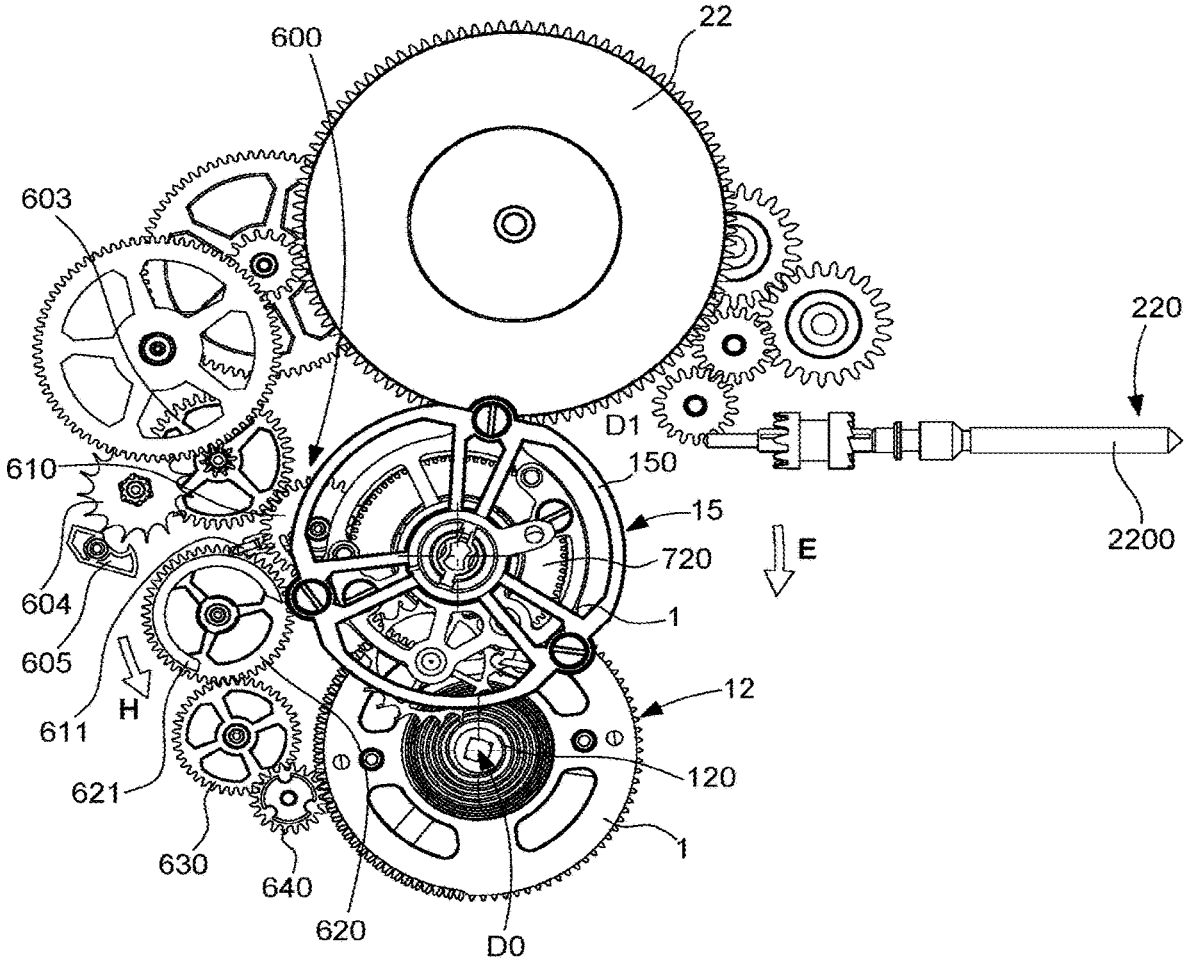
Figure 19:
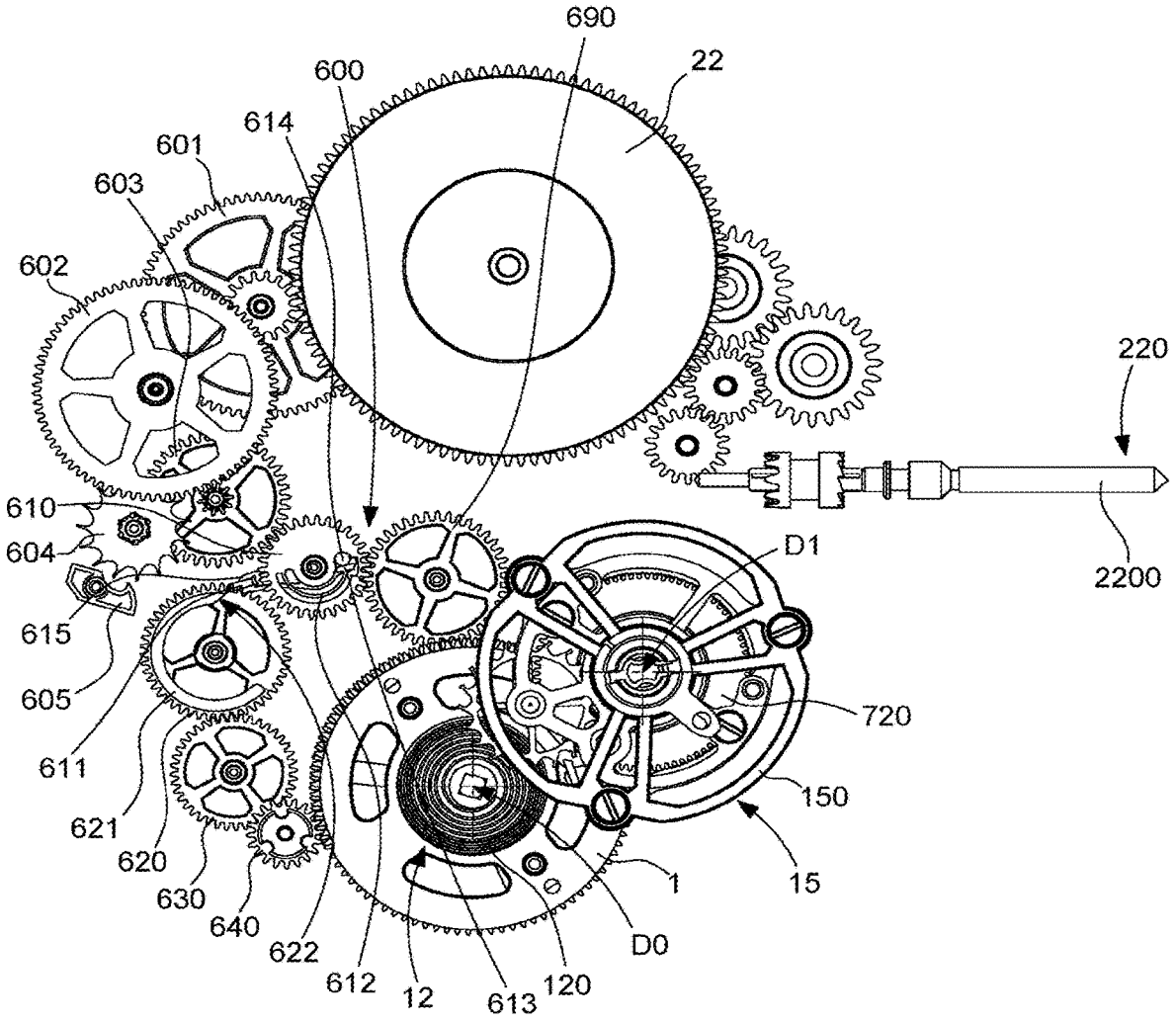
Figure 20:
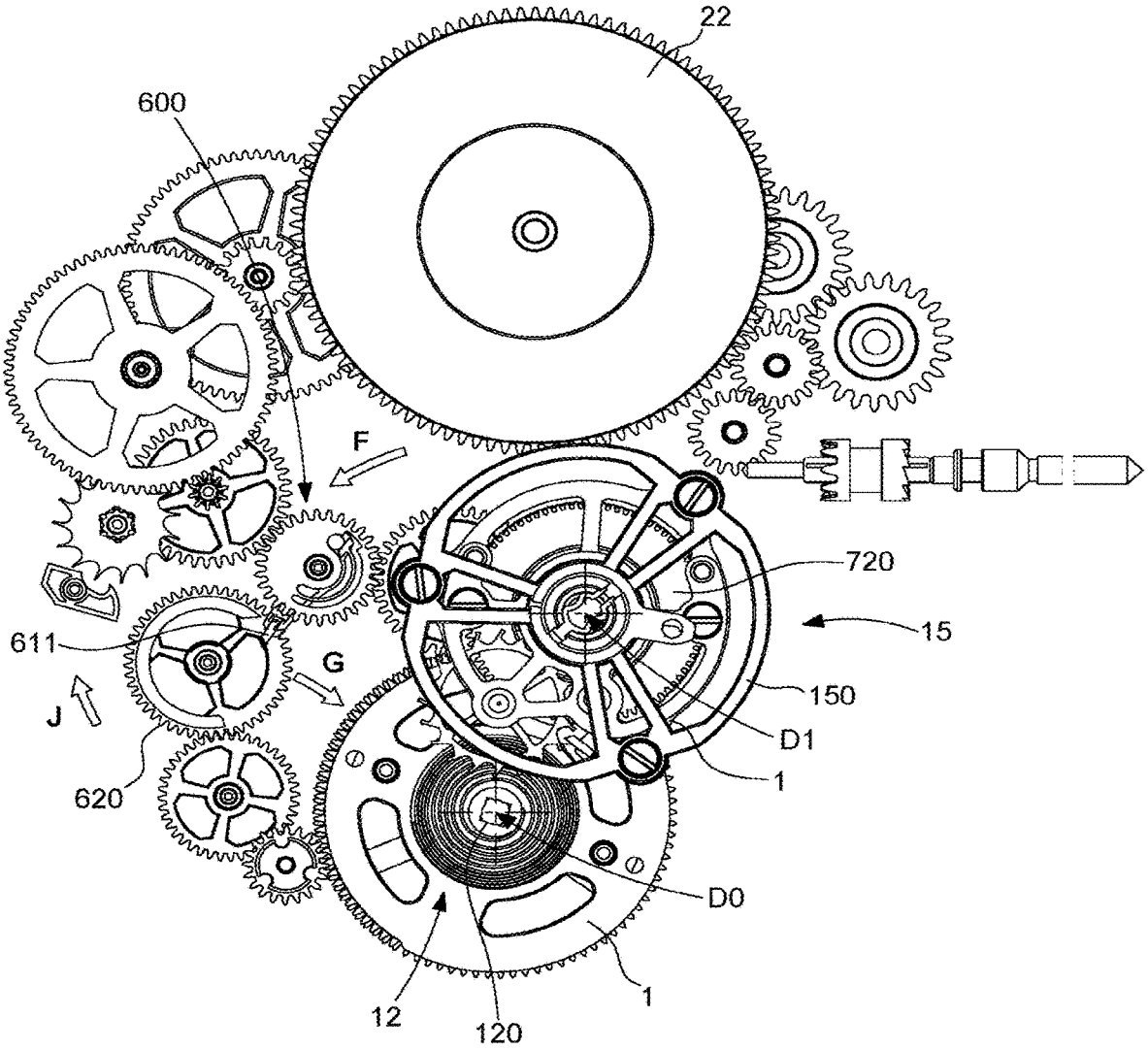
Figure 21:
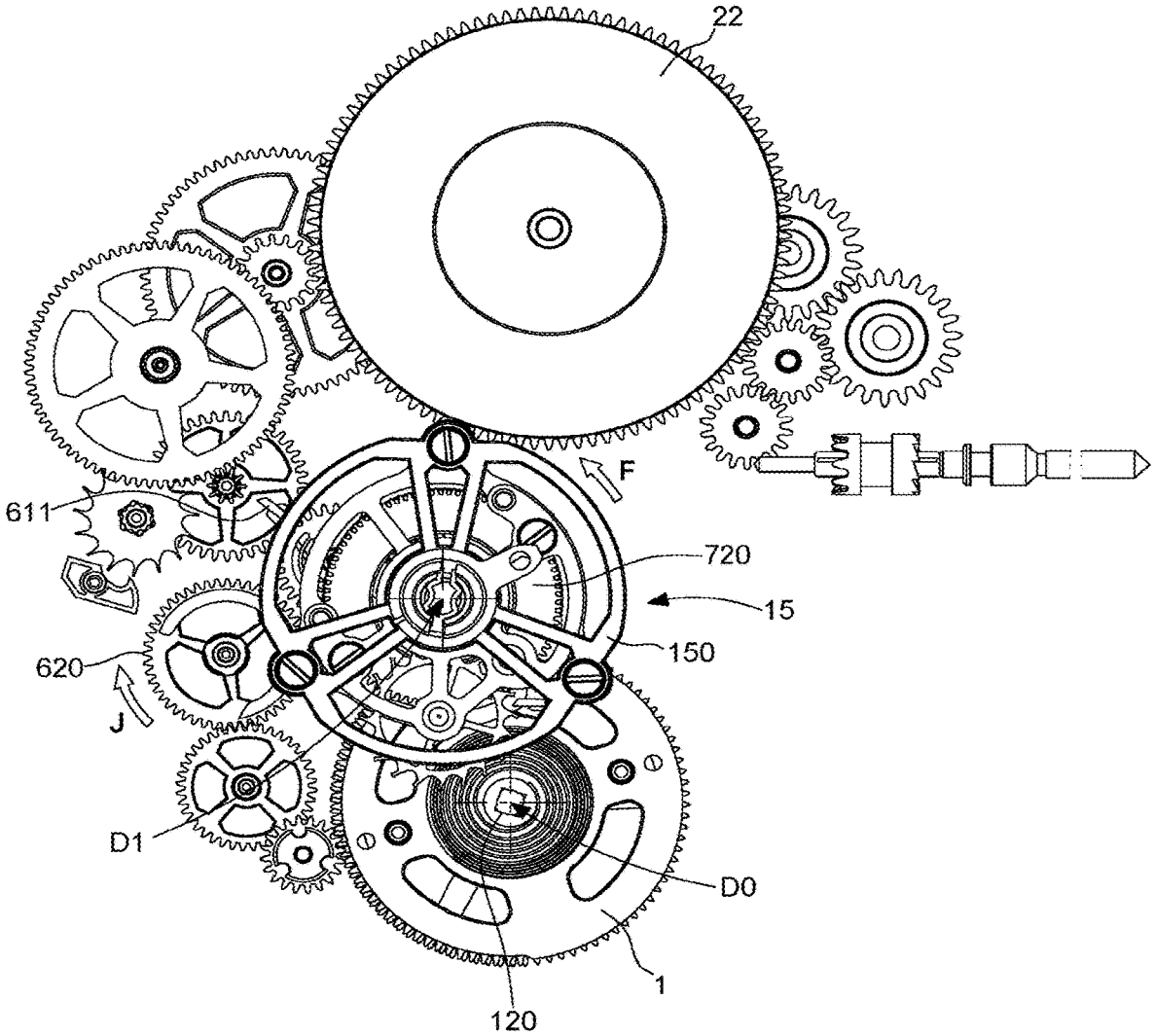

In this way, it is conceivable to develop several types of displacement of the hour and minute hand, as well as complications such as the indications of the moon, and/or day/night, and/or the power reserve, as visible in FIGS. 11 to 13, particularly, upon return of the frame and the third mobile, or else with the position geartrain wherein it is no longer necessary to use a cannon-pinion, and where the hand-setting is unidirectional; or with the position geartrain; with the position geartrain and/or the movement barrel, the hand-setting is possible in both directions.

Winding is made by the crown 220, the main barrel 22 will no longer intercede with the goingtrain as in the usual technique.

This arrangement also allows to make the correction of the moon directly by the crown, it is no longer necessary to integrate a corrector integrated into the middle part.

It is understood that the invention ensures an almost constant motive force to the regulating mechanism, in particular a tourbillon or karussel frame, throughout the power reserve of the main barrel.

FIGS. 11 to 14 illustrate the wide latitude provided by the invention for the positioning of the various displays. In the illustrated example, the hours and minutes are read on a dial at 12 o'clock, that of the power reserve on a sector with a retrograde hand at 9 o'clock, that of the moon and/or day/night, or else sunset display, or the like, at 3 o'clock, while the tourbillon has a displacement over 120°, and it is possible to orient the displacement of the frame over 120° according to a substantially peripheral movement as in FIGS. 11 and 14, or according to a movement about a maximum eccentric axis as in FIGS. 12 and 13, with a retrograde movement of the frame respectively from left to right, or from right to left.

The value of 120° taken for the examples is in no way restrictive, the angular value depends on the duration of the desired time travel, the value of the retrograde travel is also adjustable, for example between 2 and 5 seconds, and allows obtaining a non-abrupt retrograde return, devoid of shock.

The retrograde return of the frame allows powering the minute passage.

The retrograde return is not related to the frequency of the resonator mechanism, and has no influence on the working of the movement.

In other variant embodiments, it is possible to equip the third mobile with several satellites 10 on its periphery. It is also possible to design a multi-stage system to manage separate functions.

FIGS. 15 to 31 illustrate, on the basic principle of FIG. 10, a particular embodiment of the invention, wherein the first wheel 11 is a tourbillon frame 150, and where the third mobile 3 is a frame pitch mobile 700, which will be detailed later.

According to the invention, in this embodiment, the horological movement 500 includes, for controlling the retrograde movement of the retrograde pivoting arm 1, a very compact mechanism which includes a release mobile 600 kinematically connected to the second energy source 22, and which is arranged to cooperate with a cam mobile 620 kinematically connected to the arm 1 connected to the first energy source 12.

This horological movement 500 includes at least one regulating organ which is a tourbillon or karussel including a frame 150. The movement 500 includes a drive mechanism 100 including a fixed structure 110 on which an arm 1 carrying the frame 150 is pivotally mounted about a main axis D0. This arm 1 is subjected to the return torque of a first energy source 12. The drive mechanism 100 also includes at least one second energy source 22, arranged for permanently re-powering the first energy source 12.

According to the invention, the second energy source 22 is arranged to drive a frame pitch mobile 700, which in turn drives a frame pinion 710 for rotating the frame 150.

And the movement 500 includes, for periodically controlling a retrograde movement of the arm 1, a release mobile 600 kinematically connected to the second energy source 22 and always turning in the same direction, and which is arranged to cooperate, at a pallet-stone 601 that the release mobile 600 includes, with a cam 621 that a cam mobile 620 kinematically connected to the arm 1 includes.

This cam 621 covers an angular sector less than 360° and which corresponds to a forward movement of the arm 1 pivoting in a first direct direction E at a first constant speed relative to the fixed structure 110 as long as the pallet-stone 601 is resting on the cam 621. An interruption of the cam 621 is arranged to release a drop of the pallet-stone 601 of the release mobile 600 under the action of the motor torque of the second energy source 22, and to control a rapid retrograde return of the arm 1 in a second retrograde direction F relative to the fixed structure 110 at a second speed greater than the first speed, during the drop of the pallet-stone 601 between the moment when it leaves the cam 621 and the moment when it returns to rest on the cam 621, the cam mobile 620 performing, during the drop, a retrograde pivoting under the effect of the retrograde return of the arm 1.

The mechanism according to the invention thus includes two branches, one powered by the first energy source 12, the other by the second energy source 22, and the point of convergence of these two branches is the cooperation area between the release mobile 600 and the cam mobile 620. This cooperation is periodic, because its period is determined by the oscillator of the tourbillon, in particular a balance-spring or the like.

These two branches will successively be examined from their energy supply.

The retrograde pivoting arm 1 is here pivoted on the plate or on a structure 110 that the movement 500 includes. The first energy source 12 here includes, without limitation, at least one frame arm spring 120, fixed at a first end to the retrograde pivoting arm 1, and to the plate or the structure 110 at its other end; in the figures, and in a non-limiting manner, this frame arm spring 120 is a balance-spring.

A block groups together, mounted coaxially around the axis D0 and free relative to one another, on the one hand the eight-shaped retrograde pivoting arm 1 carrying a frame 150 on its eccentric portion, and which carries a first end of a frame arm spring, and on the other hand a frame pitch mobile 700 which includes a first lower wheel 680 and a second intermediate wheel 670 axially spaced apart and integral in rotation, and which are also coaxial and axially spaced from a toothed sector 660 (or a complete toothing) that the retrograde pivoting arm 1 includes.

The frame pitch mobile 700 including the first lower wheel 680 and the second intermediate wheel 670 is blocked or freed according to the relative position of the release mobile 600 and the cam mobile 620, as will be explained below. This frame pitch mobile 700 constitutes a 120° SIAM (counterclockwise direction) pitch wheel.

The retrograde pivoting arm 1 carries a fixed tourbillon wheel 720, with which the pinion of an escapement wheel of an escapement mechanism cooperates, which is not detailed here since it is conventional, for example an escapement with Swiss pallet cooperating with a balance-spring not shown in the figures where only the escapement wheel is visible. In particular, but in a non-limiting manner, the imposed frequency is one frame rotation per minute.

As a result, the retrograde pivoting arm 1 can only travel one angular travel of maximum 120° in one minute, corresponding to a complete revolution of the frame: in a direct direction for approximately fifty-eight seconds of slow speed travel of the arm 1 in the first elementary travel, and approximately two seconds of rapid return in a retrograde direction of the arm 1 in the second elementary travel.

The toothed sector 660 meshes, directly, or indirectly as in the figures, with a cam mobile 620, which therefore undergoes direct or retrograde movements like the retrograde pivoting arm 1: when the retrograde pivoting arm 1 pivots in the direct direction E, the cam mobile 620 pivots in a direct direction H, and, when the retrograde pivoting arm 1 pivots in the retrograde direction F, the cam mobile 620 pivots in a retrograde direction J.

In the variant of the figures, the toothed sector 660 indirectly meshes with the cam mobile 620 through a cam geartrain, which is illustrated in a non-limiting manner here by a first setting-wheel 630 and a second setting-wheel 640 carrying a pinion 650. In a particular version, this cam geartrain includes at least one component adjustable by friction or the like: for example, the second setting-wheel 640 may include two snap-on cannon-pinions cooperating with each other by friction for a fine adjustment in the factory or in after-sales service of the angular orientation of the upper pinion 650 relative to the other lower toothing carried by this second setting-wheel 640, to adjust if necessary the retrograde angle of 120°, or other.

This cam mobile 620 includes or carries a cam 621, which covers an angular sector of less than 360° and which corresponds to a forward movement of the retrograde pivoting arm 1, the interruption of the cam 621 being arranged to release a drop of a pallet-stone 611 that the release mobile 600 includes, and to control a rapid retrograde return of the retrograde pivoting arm 1.

This cam mobile 620 has alternating rotations in both directions, according to the direction of angular movement of the retrograde pivoting arm 1.

More particularly, this cam 621 is a cam with linear torque, with a track coaxial with the axis of the cam mobile 620. This cam 621 covers an angular sector less than 360°, selected depending on the desired kinematics, and extended by a clearance 623. The cam 621 includes a cam point 622 at one of its ends.

If, in the preferred variant illustrated by the figures, the track of the cam 621 is cylindrical, it is understood that its profile could be other than circular, without altering its function of animating the retrograde mechanism. The use of another profile, with a cam of particular shape, allows particular manoeuvres of the displays, for example to avoid certain areas, at the cost of slight energy consumption.

Now the second branch of the mechanism is considered.

The second energy source 22 here includes, without limitation, at least one main barrel, which is recharged with energy by known means, the figures illustrate more particularly and without limitation a single main barrel 22, re-coiled through a geartrain winding, not detailed here, by a time-setting and winding rod 2200, arranged to be actuated by the crown 220. Naturally, this second energy source 22 can be of any kind customary in watchmaking, for example an electric source capable of rotating a mobile, or the like.

Here, this main barrel 22 conventionally drives a goingtrain, which includes a large-medium mobile 601, and a small-medium mobile 602. The latter drives a finishing mobile 603.

More particularly, the second energy source 22 drives, through the goingtrain, the finishing mobile 603, which drives a release mobile 600, which always turns in the same direction.

This release mobile 600 includes a release finger wheel 610, which meshes with the finishing mobile 603. As shown in particular in FIG. 30, this release finger wheel 610 is mounted coaxially, around an axis 619, with a release finger 615 carrying a pallet-stone 611.

Preferably, the release finger wheel 610 and the release finger 615 have a small angular mobility with an angle α of one relative to the other, of the order of a few degrees, and in particular of less than 15 degrees.

Advantageously, the release finger wheel 610 carries or includes a spring arm 612, one distal end of which forming a hammer 613 is arranged to cooperate in abutment support with a pin 614 carried by the release finger 615. The release finger wheel 610 includes, on the one hand a rear abutment surface 618 for limiting the relative angular travel of the pin 614, and on the other hand a front abutment surface 617 for limiting the angular travel of the hammer 613. The spring arm 612 is here made in one piece with the release finger wheel 610 and is movable in an opening 6120 that the latter includes, and the inner surfaces of which limit the radial travel of the spring arm 612; the spring arm 612 can also be an insert, the radial travel of which is then limited by abutment surfaces provided for this purpose. In another embodiment, the whole release mobile 600 is a one-piece component.

Now the cooperation between the release mobile 600 and the cam mobile 620 is considered.

At the cam wheel 620, the track of the cam 621 is provided to serve as a support for the pallet-stone 611 of the release finger 610: as long as the pallet-stone 611 is in abutment on the track of the cam 621, the retrograde pivoting arm 1 is animated with a steady forward movement in the direct direction, until the point of the pallet-stone 611 rests on the cam point 622, last instant before the drop of the pallet-stone 611: The release 623 of the cam wheel 620 is provided to allow, without hindering it, the passage of the pallet-stone 611 along the cam mobile 620: when the point of the pallet-stone 611 leaves the cam point 622, the pallet-stone 611 drops and performs a rapid movement under the driving effect of the goingtrain, this rapid movement begins with the passage of the pallet-stone 611 in the clearance 623, then the pallet-stone 611 leaves the grip of the cam mobile 620, and the release finger wheel 610 tends to perform a full turn around its axis, until the pallet-stone 611 returns to rest on the track of the cam 621. This cam 621 has also rotated in the meantime. Indeed, when separating the pallet-stone 611 and the cam 621, nothing more retains the cam wheel 620, nor consequently the retrograde pivoting arm 1 which is returned in rapid retrograde movement under the action of the frame arm spring 120, and of course the cam wheel 620 also performs such a retrograde movement for about 2 seconds.

During this rapid return travel, the speed of the mobiles, and in particular of the release mobile 600, is limited by a regulator mobile 604, including for example a star meshing with the finishing mobile 603 and cooperating with pallets 605.

Figure 22:
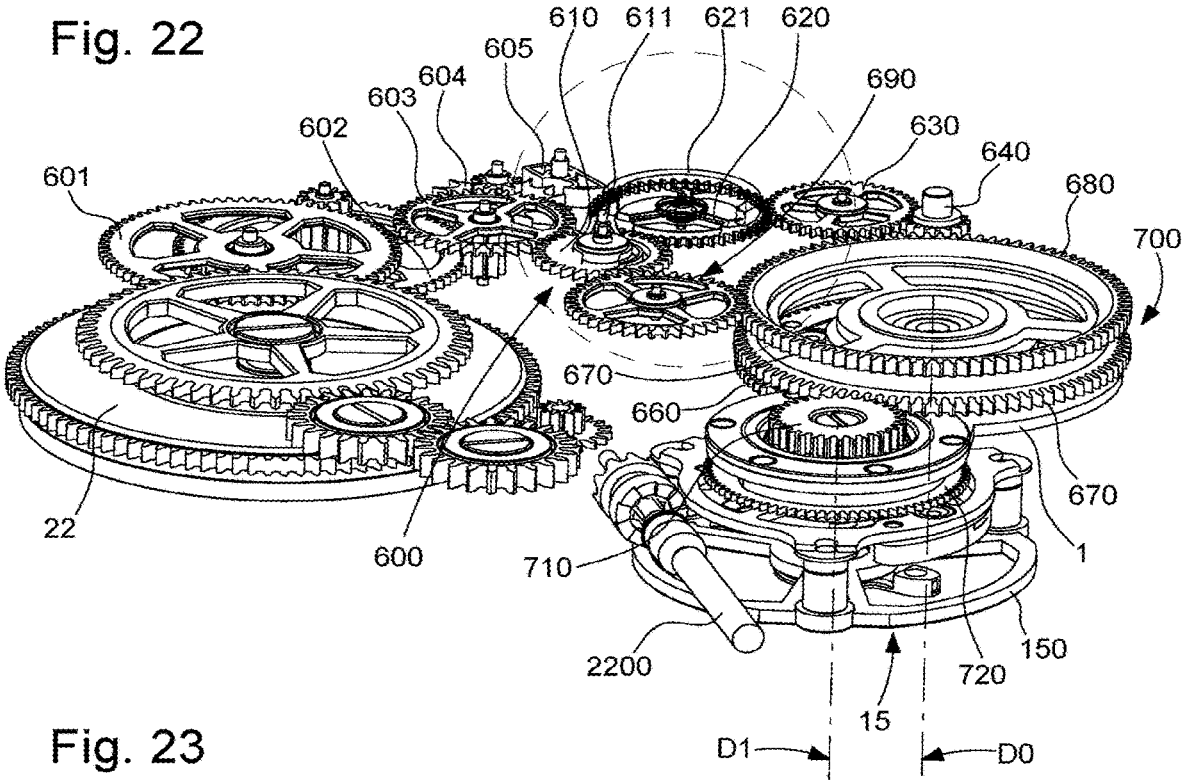
Figure 23:
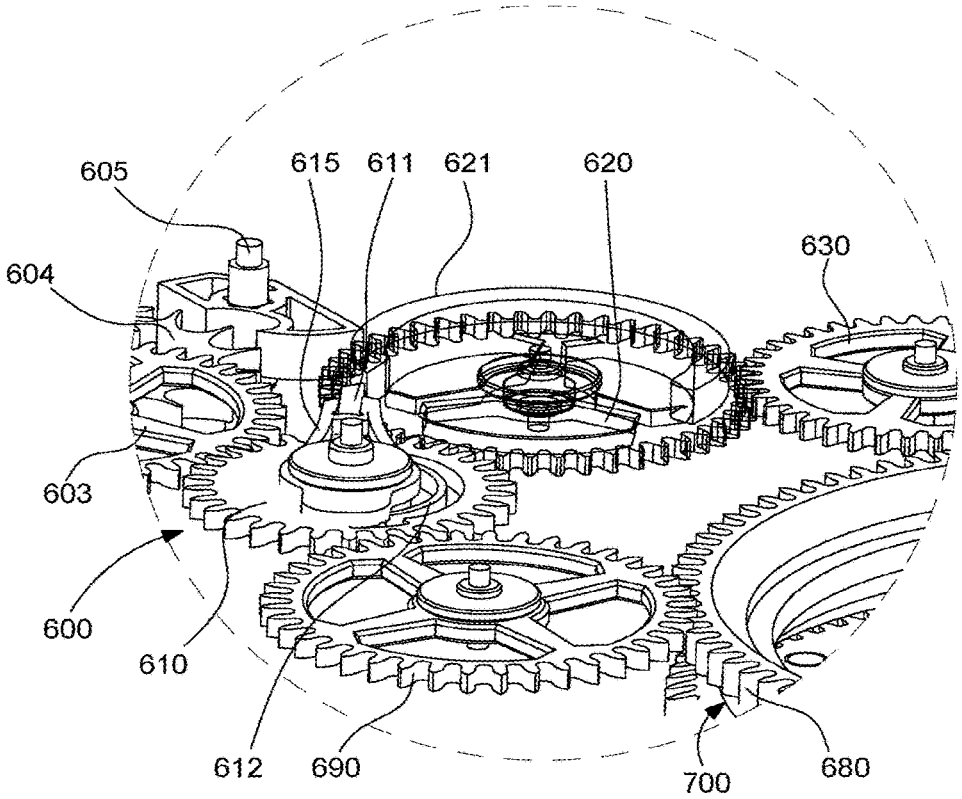
Figure 24:
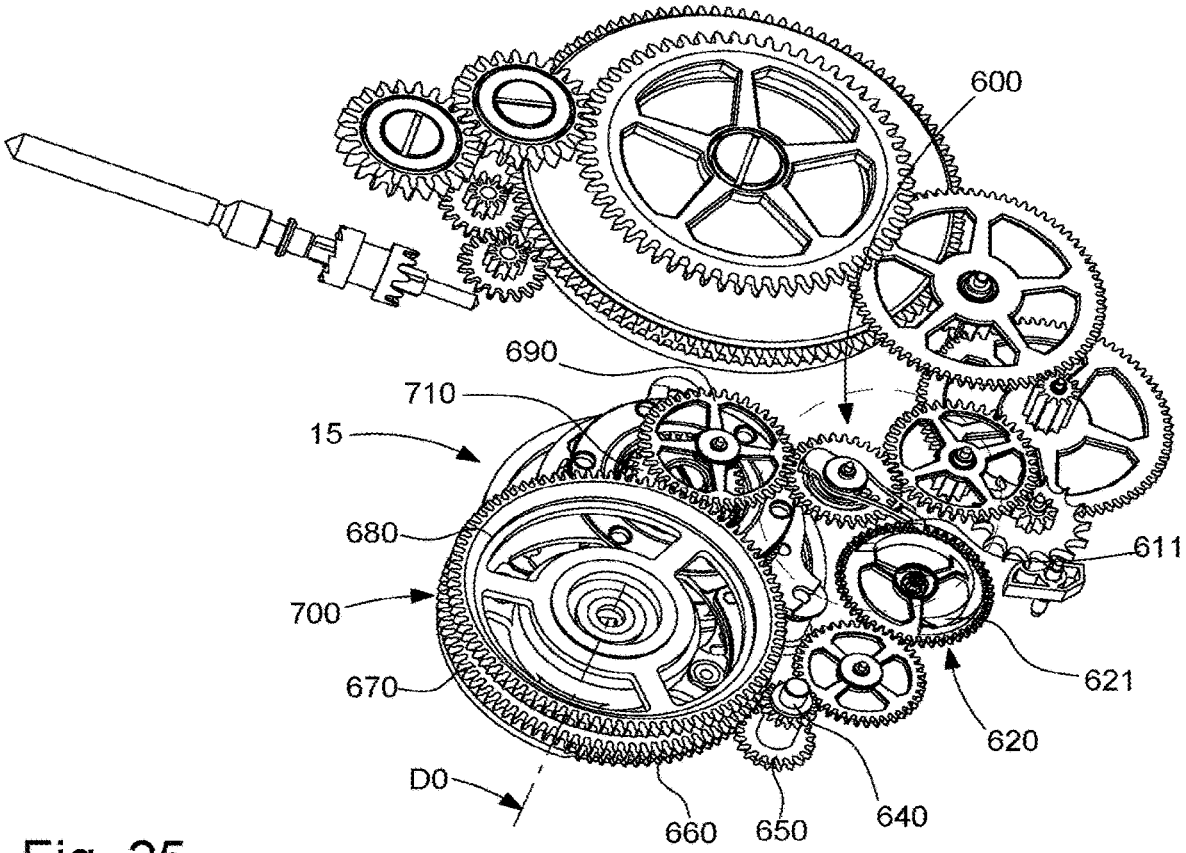
Figure 25:
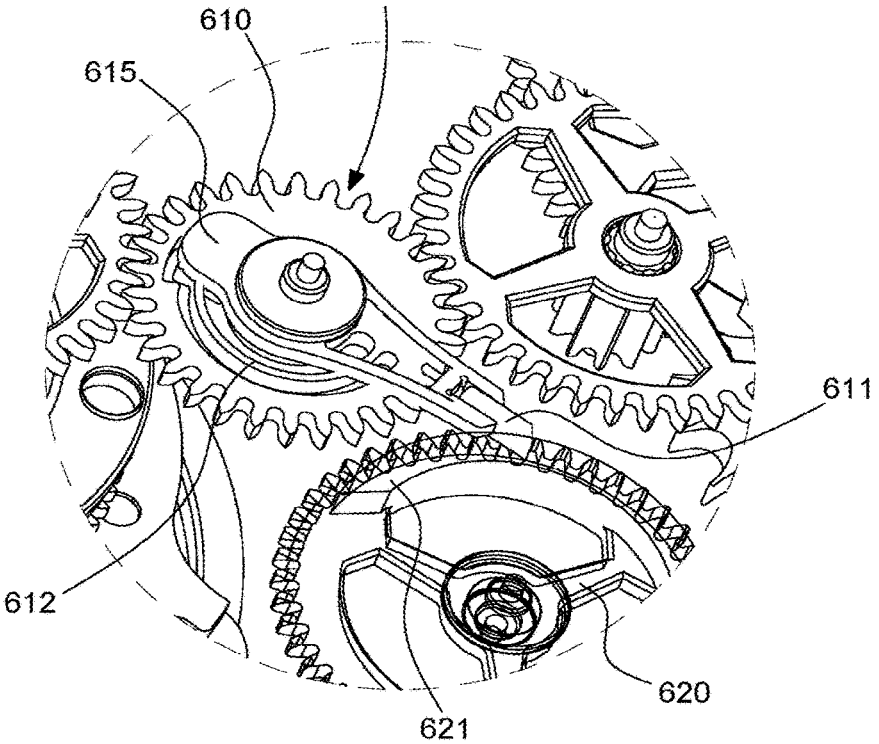
Figure 26:
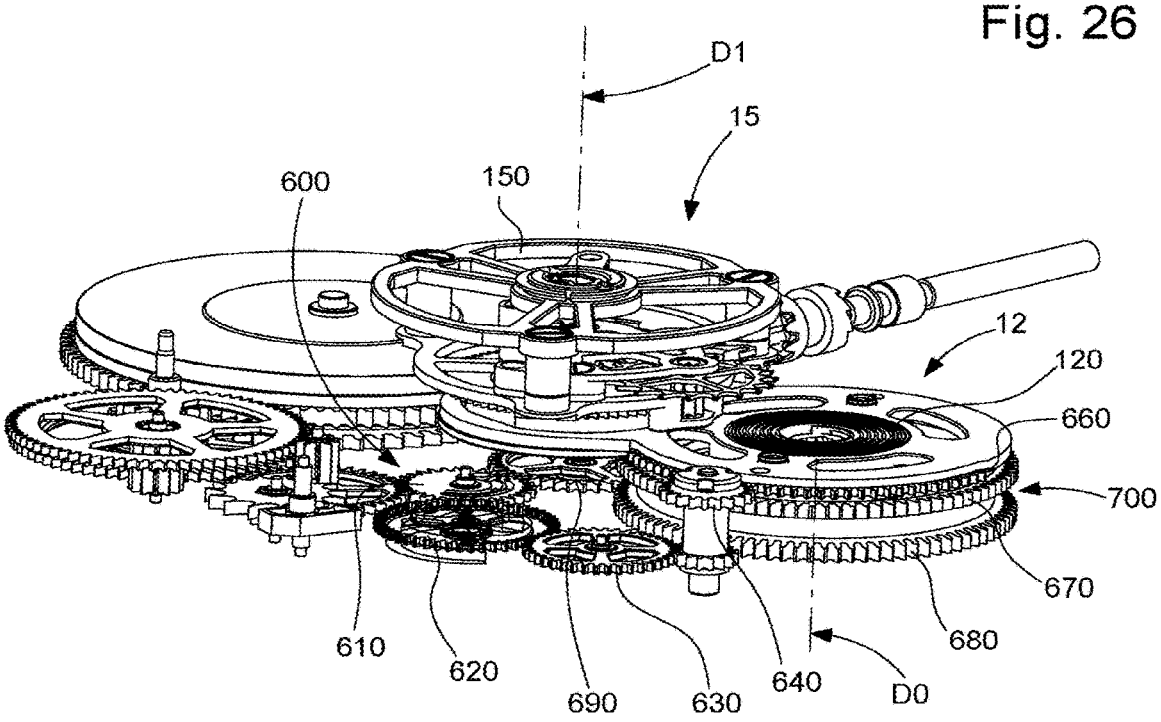
Figure 27:
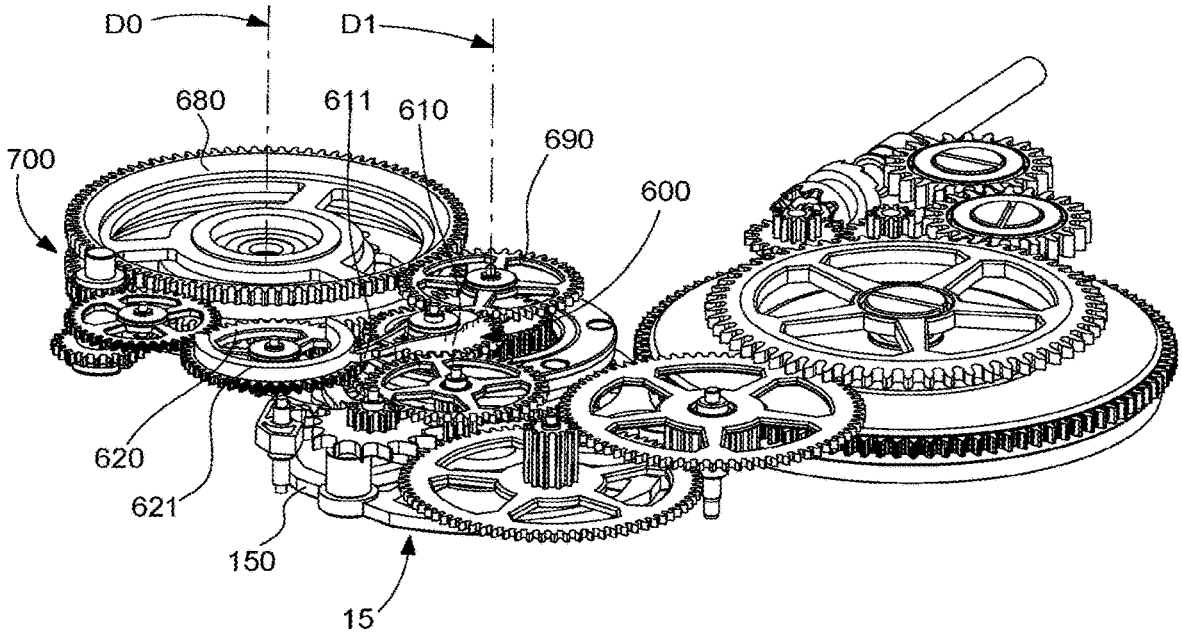
Figure 28:
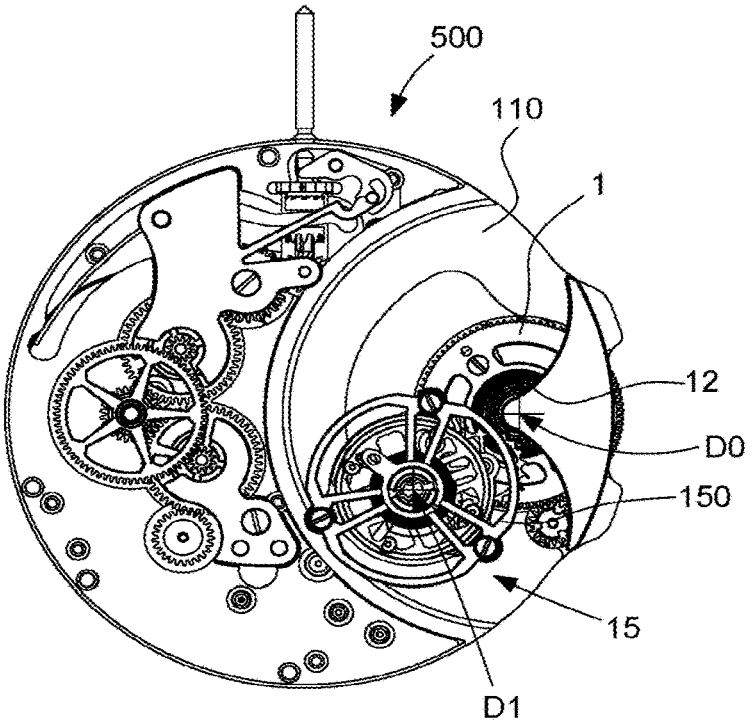
Figure 29:
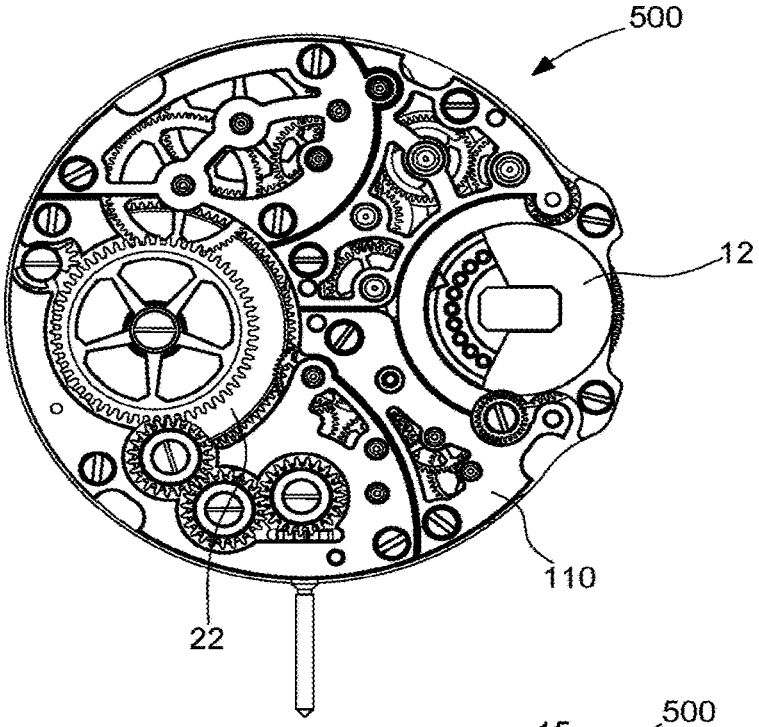
Figure 30:
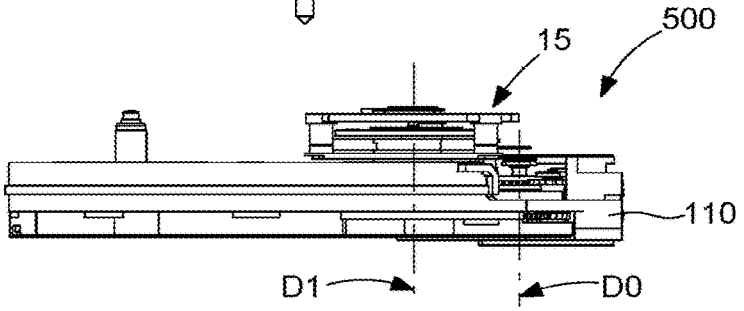
Figure 31:
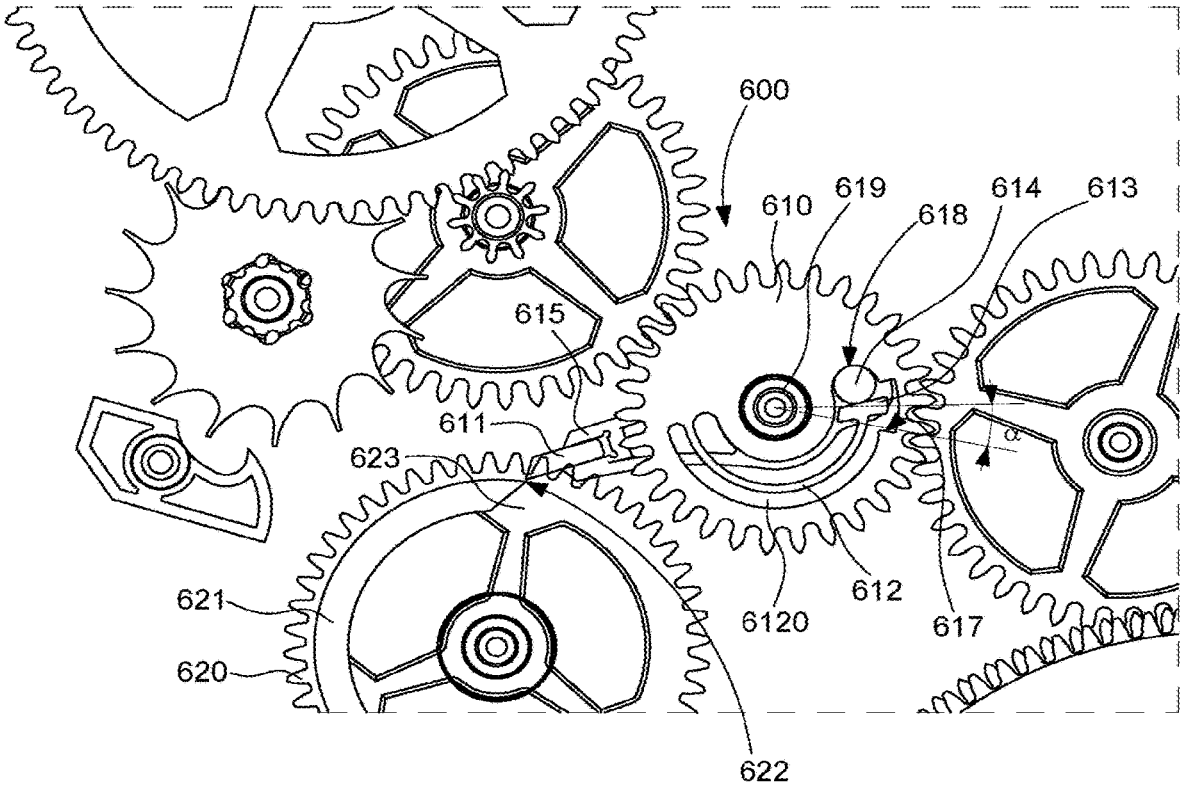

The second intermediate wheel 670 of the frame pitch mobile 700 meshes with a frame pinion 710 which drives the frame 150, as visible in FIG. 22. This same FIG. 22 also shows the meshing between a setting-wheel 690, with which meshes the release mobile 600, with the first lower wheel 680 of the frame pitch mobile 700.

It is therefore understood that, as long as the pallet-stone 611 of the release mobile 610 is in contact with the cam track 621 of the cam wheel 620, the frame pitch mobile 700 is held stationary by the setting-wheel 690 which meshes with the release mobile 610, which is immobile. When the pallet-stone drops, the energy of the main barrel 22 is freed, and causes the rapid rotation, however braked by the pallet 605, of the geartrain and of the frame pitch mobile 700, which drives in its rotation the pinion of frame 710.

During the two seconds of the drop the frame pitch mobile 700, which is independent of the retrograde pivoting arm 1, turns, and thus drives the tourbillon frame, until the end of the drop, and the frame pitch mobile 700 is then stopped. Naturally the tourbillon frame continued its rotation, always in the same direction and at the same speed, during the duration of the drop. During the drop the cam wheel 620 is driven in its retrograde direction J, and, at the end of the drop, is in an angular position wherein the cam 621 receives in the pallet-stone 611 in radial support.

When the retrograde pivoting arm 1 returns to the starting position and resumes its course in the direct direction, the frame pitch mobile 700 is thus stopped.

In sum, the cam wheel 620 has a reciprocating movement with periodic releasing, the period of which depends on the frequency of the oscillator of the tourbillon.

It is understood that, here, the two energy sources have different functions: the main barrel of the movement 500, which is here the second energy source 22, defines the power reserve, powers the system, but does not directly power the resonator; while the first energy source 12 here constituted by the frame spring 120 (which could also be a barrel, or the like), drives the cam mobile 620 carrying the cam 621, in this particular example controls the 120° winding/letting down, powers the oscillator, and performs the movements +120° and −120°; the second energy source 22 continuously re-powers the first energy source 12.

Figure 32:
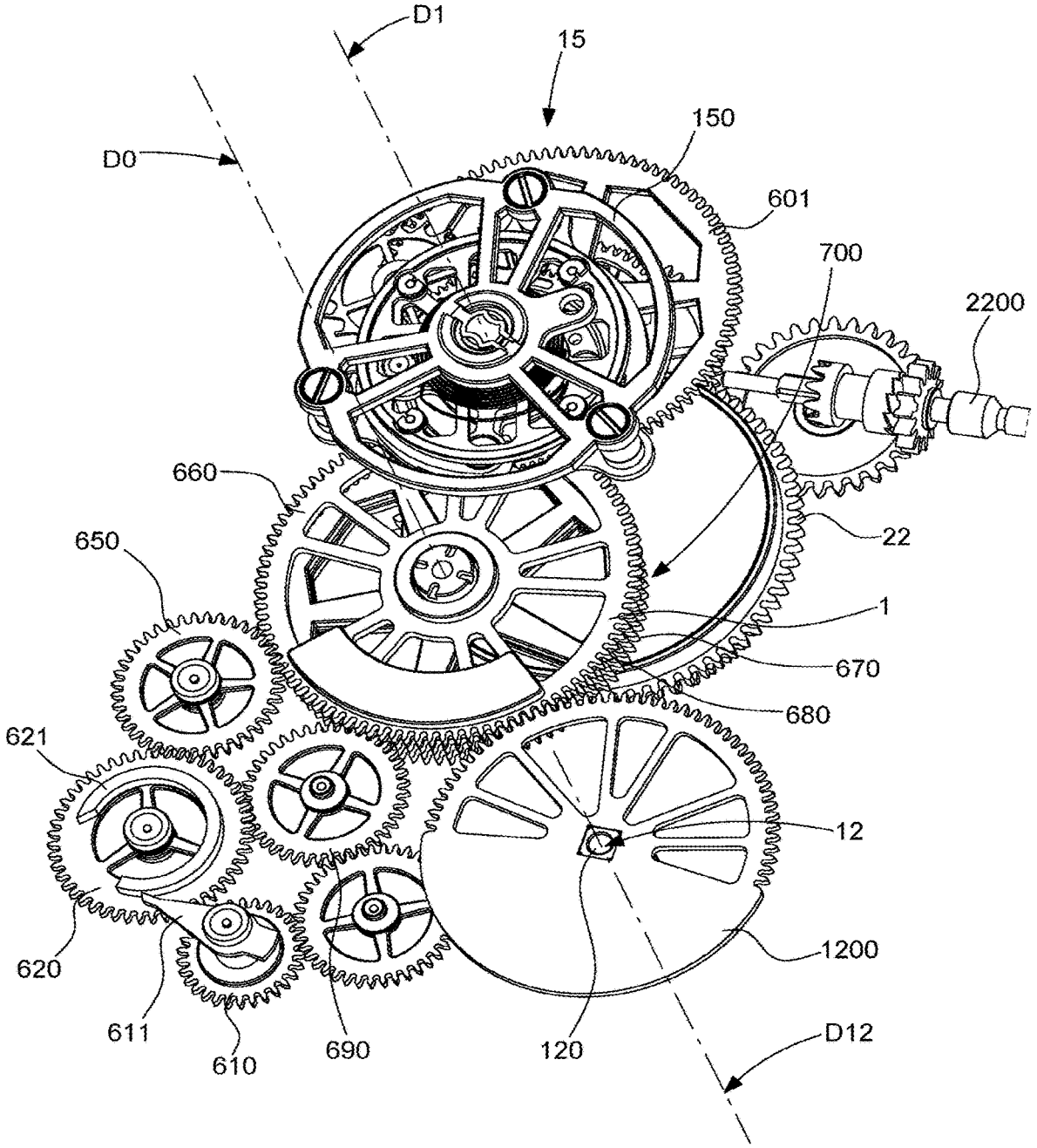
FIGS. 32 to 34 show, respectively in perspective, in top view and in bottom view, a variant of the mechanism of FIGS. 15 to 31, with the block composed of the arm and the frame pitch mobile separated from the first energy source, which is offset on the plate.
Figure 33:
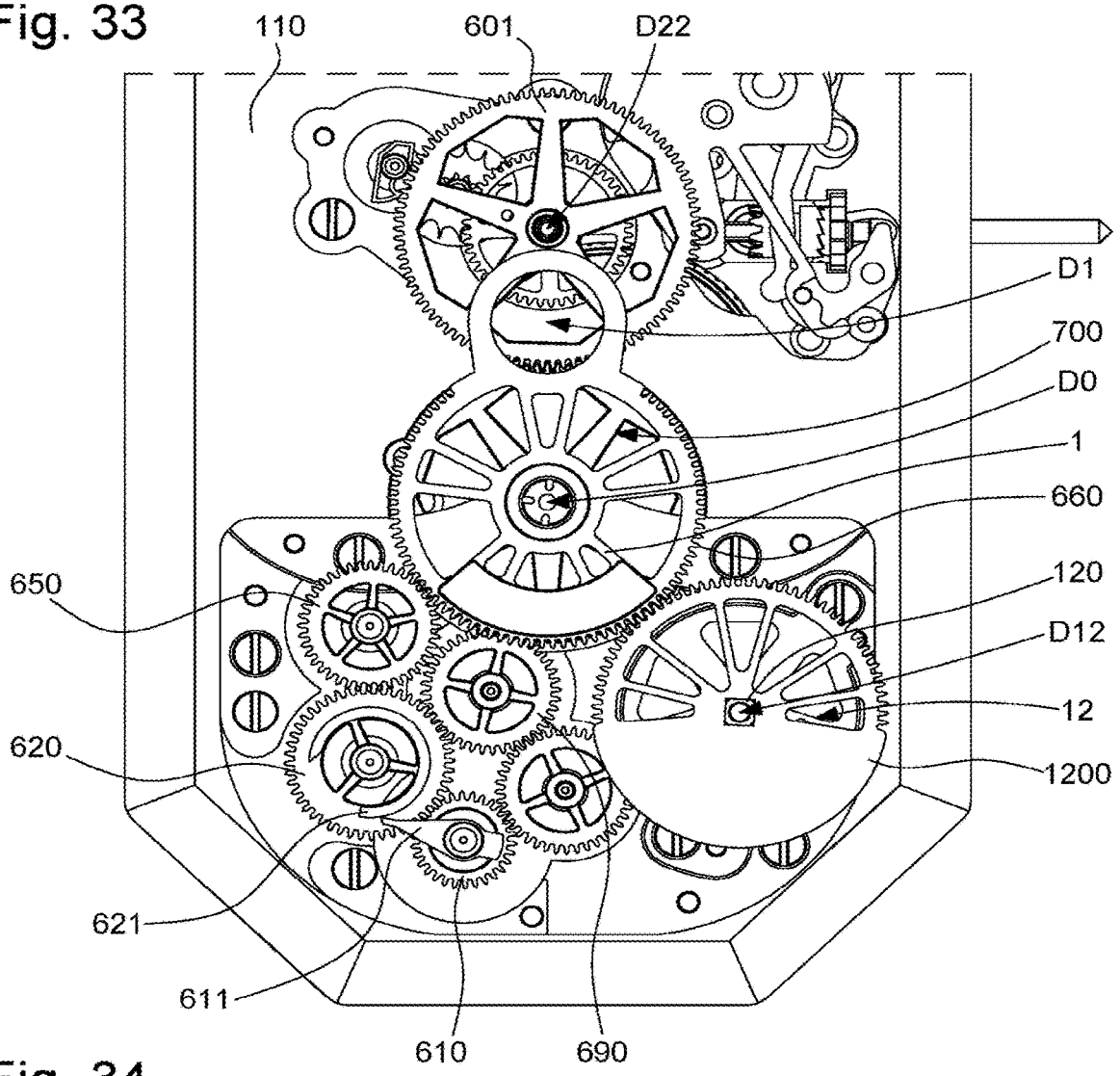
Figure 34:
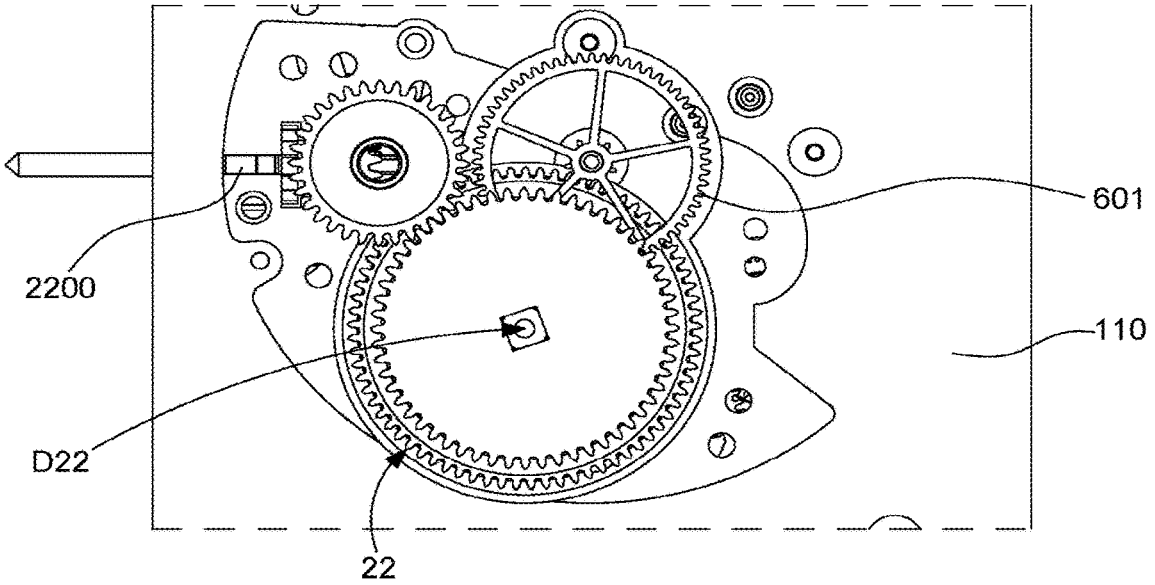

FIGS. 32 to 34 illustrate a variant of the mechanism of FIGS. 15 to 31, with the block composed of the arm and of the frame pitch mobile is separated from the first energy source, which is offset on the plate or fixed structure 110, and which includes a first wheel 1200 cooperating with the frame arm spring 120, and which meshes with the toothed sector 660 of the retrograde pivoting arm 1. In this mechanism the geartrains are represented in a simplified manner, to highlight the two branches of energy circulation:

- the branch powered by the first energy source 12 successively includes this first wheel 1200, the retrograde pivoting arm 1 with the fixed tourbillon wheel 720, a setting-wheel 650, and the cam wheel 620;
- the branch powered by the second energy source 22 successively includes, from below the movement visible in FIG. 34, the main barrel, a medium wheel 601 whose shaft crosses the plate or fixed structure 110, the frame pitch mobile 700 (the second intermediate wheel 670 of which meshes with the frame pinion not shown here), the setting-wheel mobile 690 and another setting-wheel, then the release mobile 610.

The operation of the mechanism is thus ensured by short kinematic chains, including few components, which are easy and economical to execute. The invention allows producing an innovative complication with a low space consumption in the watch case.

The invention claimed is:

1. A horological movement comprising at least one regulating organ which is a tourbillon or karussel including a frame said movement including a drive mechanism including a fixed structure on which an arm carrying said frame is pivotally mounted about a main axis, said arm being subjected to the return torque of a first energy source, said drive mechanism further including at least one second energy source, arranged to permanently re-power said first energy source, wherein said second energy source is arranged to drive a frame pitch mobile in turn driving a frame pinion for rotating said frame and wherein said horological movement includes, for periodically controlling a retrograde movement of said arm, a release mobile kinematically connected to said second energy source and always turning in the same direction, and which is arranged to cooperate, at a pallet-stone that said release mobile includes, with a cam that a cam mobile kinematically connected to said arm includes, and wherein said cam covers an angular sector less than 360° and which corresponds to a forward movement of said arm pivoting in a first direct direction E at a first constant speed relative to said fixed structure as long as said pallet-stone is resting on said cam, an interruption of said cam being arranged to release a drop of a pallet-stone that said release mobile includes under the action of the motor torque of said second energy source, and to control a rapid retrograde return of said arm in a second retrograde direction F relative to said fixed structure at a second speed greater than said first speed, during the drop of said pallet-stone between the moment when it leaves said cam and the moment when it returns to rest on said cam, said cam mobile performing, during said drop, a retrograde pivoting under the effect of the retrograde return of said arm.

2. The horological movement according to claim 1, wherein said release mobile comprises a release finger wheel, which meshes with a mobile of a goingtrain powered by said second energy source, and which is mounted coaxially, about an axis, with a release finger carrying said pallet-stone, and wherein said release finger wheel and said release finger have an angular mobility with an angle $\alpha$ of one relative to the other, less than 15 degrees.

3. The horological movement according to claim 2, wherein said release finger wheel carries or includes a spring arm, one distal end of which forming a hammer is arranged to cooperate in abutment support with a pin carried by said release finger, and wherein said release finger wheel includes, on the one hand, a rear abutment surface for limiting the relative angular travel of said pin, and on the other had a front abutment surface for limiting the angular travel of said hammer.

4. The horological movement according to claim 3, wherein said spring arm is made in one piece with said release finger wheel and is movable in an opening that the latter includes, and the inner surfaces of which limit the radial travel of said spring arm.

5. The horological movement according to claim 1, wherein the whole of said release mobile is a one-piece component.

6. The horological movement according to claim 1, wherein said frame pitch mobile comprises a first lower wheel and a second intermediate wheel axially spaced apart and integral in rotation, and which are also coaxial and axially spaced from a toothed sector or a complete toothing that said retrograde pivoting arm includes, said second intermediate wheel meshing with said frame pinion, and said first lower wheel meshing with a setting-wheel, with which meshes the release mobile.

7. The horological movement according to claim 6, wherein said toothed sector or said complete toothing that said retrograde pivoting arm comprises indirectly meshes with said cam mobile through a cam geartrain which includes at least one setting-wheel including two snap-on cannon-pinions cooperating with each other by friction for a fine adjustment of the orientation of the retrograde angle of said arm.

8. The horological movement according to claim 1, wherein said retrograde pivoting arm carries a fixed tourbillon wheel, with which cooperates the pinion of an escapement wheel of an escapement mechanism cooperating with a balance-spring that said movement includes.

9. The horological movement according to claim 1, wherein said drop of said pallet-stone and the speed of the mobiles, and of said release mobile is limited by a regulator mobile, including a star meshing with a mobile of a goingtrain powered by said second energy source, and cooperating with pallets.

10. The horological movement according to claim 1, wherein said frame pitch mobile is coaxial with said first energy source around said main axis.

11. The horological movement according to claim 1, wherein a block composed of said retrograde pivoting arm and said frame pitch mobile is separated from said first energy source, which is offset on said fixed structure, and which includes a first wheel cooperating with a frame arm spring that said first energy source includes, and which meshes with a toothed sector or said complete toothing that said retrograde pivoting arm includes.

12. A timepiece including comprising at least one horological movement according to claim 1.

13. The timepiece according to claim 12, wherein it is a watch, and wherein said first energy source and/or said second energy source is a barrel.

* * * * *